US008722293B2

(12) United States Patent
Iida et al.

(10) Patent No.: US 8,722,293 B2
(45) Date of Patent: May 13, 2014

(54) ELECTROSTATIC CHARGE IMAGE DEVELOPING TONER, ELECTROSTATIC CHARGE IMAGE DEVELOPER, TONER CARTRIDGE, PROCESS CARTRIDGE, IMAGE FORMING APPARATUS, AND IMAGE FORMING METHOD

(75) Inventors: Yoshifumi Iida, Kanagawa (JP); Hideaki Yoshikawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 5 days.

(21) Appl. No.: 13/566,534

(22) Filed: Aug. 3, 2012

(65) Prior Publication Data

US 2013/0196259 A1 Aug. 1, 2013

(30) Foreign Application Priority Data

Jan. 31, 2012 (JP) ..... 2012-019182
Jan. 31, 2012 (JP) ..... 2012-019183

(51) Int. Cl.
*G03G 9/097* (2006.01)

(52) U.S. Cl.
CPC ..... *G03G 9/09725* (2013.01); *G03G 9/09708* (2013.01)
USPC ..... 430/108.7; 430/108.6; 430/123.51

(58) Field of Classification Search
CPC ..... G03G 9/09708; G03G 9/09725
USPC ..... 430/108.6, 108.7, 123.51
See application file for complete search history.

(56) References Cited

U.S. PATENT DOCUMENTS

| | | | | |
|---|---|---|---|---|
| 6,060,202 | A * | 5/2000 | Ogawa et al. | 430/108.3 |
| 6,077,636 | A | 6/2000 | Moriki et al. | |
| 2005/0147908 | A1 | 7/2005 | Yamane et al. | |
| 2008/0226998 | A1 | 9/2008 | Ishii et al. | |
| 2008/0227015 | A1 | 9/2008 | Nagatomo et al. | |

FOREIGN PATENT DOCUMENTS

| | | |
|---|---|---|
| JP | A-2000-75541 | 3/2000 |
| JP | A-2005-121867 | 5/2005 |
| JP | A-2006-206413 | 8/2006 |
| JP | A-2008-89919 | 4/2008 |
| JP | A-2008-233256 | 10/2008 |
| JP | A-2008-257217 | 10/2008 |
| JP | A-2010-128216 | 6/2010 |

* cited by examiner

*Primary Examiner* — Peter Vajda
(74) *Attorney, Agent, or Firm* — Oliff PLC

(57) ABSTRACT

An electrostatic charge image developing toner includes toner particles, and an external additive. The toner particles are (1) prepared by forming aggregated particles by aggregating resin particles in a raw material dispersion in which the resin particles are dispersed, and causing the aggregated particles to coalesce by heating an aggregated particle dispersion in which the aggregated particles are dispersed so as to form the toner particles, or (2) obtained by kneading and pulverizing a material including a binder resin and a release agent, and the external additive is silica particles having an average diameter in the range of 100 nm to 500 nm, an average circularity in the range of 0.5 to 0.85, and an average of a ratio of a circle-equivalent diameter Da obtained by plane image analysis to a maximum height H obtained by 3-D image analysis of greater than 1.5 and less than 1.9.

18 Claims, 3 Drawing Sheets

ELECTROSTATIC CHARGE IMAGE DEVELOPING TONER, ELECTROSTATIC CHARGE IMAGE DEVELOPER, TONER CARTRIDGE, PROCESS CARTRIDGE, IMAGE FORMING APPARATUS, AND IMAGE FORMING METHOD

CROSS-REFERENCE TO RELATED APPLICATIONS

This application is based on and claims priority under 35 USC 119 from Japanese Patent Applications No. 2012-019182 and No. 2012-019183 both filed Jan. 31, 2012.

BACKGROUND

Technical Field

The present invention relates to an electrostatic charge image developing toner, an electrostatic charge image developer, a toner cartridge, a process cartridge, an image forming apparatus, and an image forming method.

SUMMARY

According to an aspect of the invention, there is provided an electrostatic charge image developing toner including toner particles and an external additive, wherein the toner particles are (1) toner particles produced by forming aggregated particles by aggregating resin particles in a raw material dispersion in which the resin particles are dispersed, and causing the aggregated particles to coalesce by heating an aggregated particle dispersion in which the aggregated particles are dispersed so as to form the toner particles, or (2) toner particles obtained by kneading and pulverizing a material including a binder resin and a release agent, and the external additive is silica particles having an average diameter in the range of 100 nm to 500 nm, an average circularity in the range of 0.5 to 0.85, and an average of a ratio of a circle-equivalent diameter Da obtained by plane image analysis to a maximum height H obtained by 3-D image analysis of greater than 1.5 and less than 1.9.

BRIEF DESCRIPTION OF THE DRAWINGS

Exemplary embodiments of the present invention will be described in detail based on the following figures, wherein.

DETAILED DESCRIPTION

Figure 1:
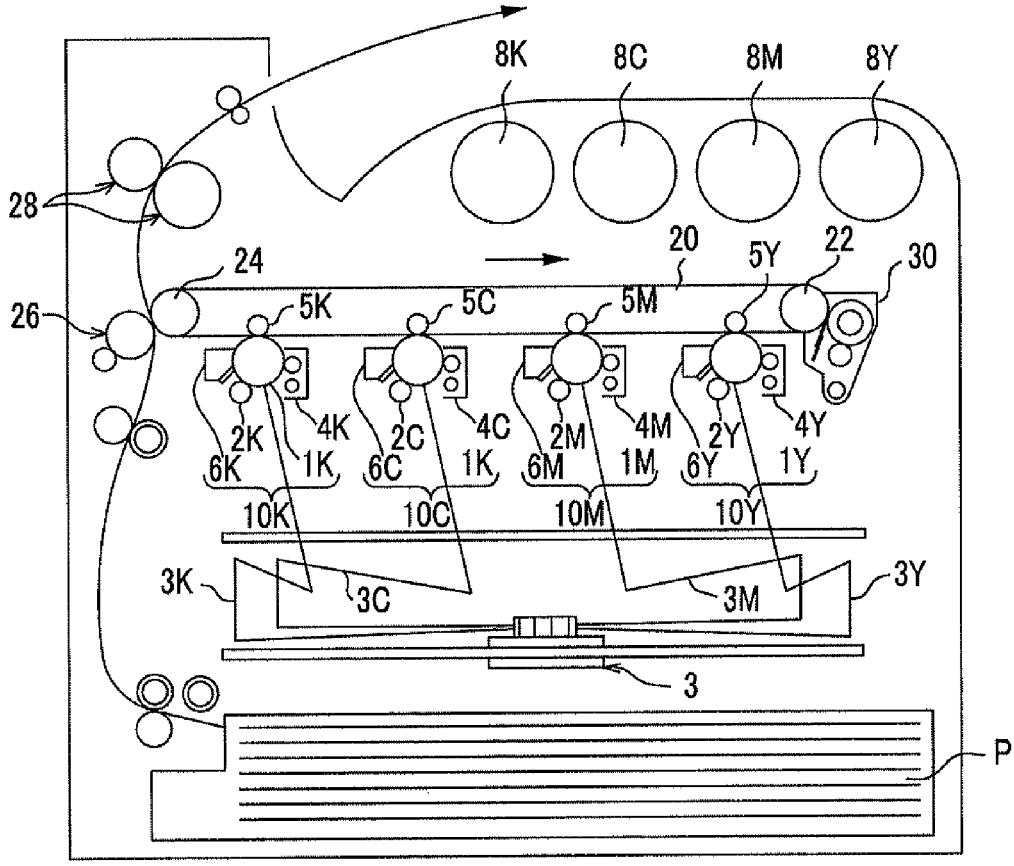
FIG. 1 is a schematic configuration view showing an example of an image forming apparatus according to the present exemplary embodiment.

Hereinbelow, exemplary embodiments of the present invention will be described in detail.

Electrostatic Charge Image Developing Toner

The electrostatic charge image developing toner (hereinbelow, simply referred to as a "toner (1)" in some cases) according to the present exemplary embodiment includes at least toner particles (hereinbelow, referred to as aggregation and coalescence toner particles in some cases) prepared by forming aggregated particles by aggregating resin particles in a raw material dispersion in which resin particles are dispersed; and causing the aggregated particles to coalesce by heating an aggregated particle dispersion in which the aggregated particles are dispersed so as to form the toner particles; and an external additive which is silica particles having an average diameter in the range of 100 nm to 500 nm, an average circularity in the range of 0.5 to 0.85, and an average of a ratio (Da/H) of a circle-equivalent diameter Da obtained by plane image analysis to a maximum height H obtained by 3-D image analysis of greater than 1.5 and less than 1.9.

It is considered that if the particle size of the external additive is set to a relatively large particle size such as a particle size of from 100 nm to 500 nm, the external additive is prevented from being embedded in toner particles, and the change in the structure of the external additive in the toner (1) is inhibited, hence development durability is obtained.

On the other hand, it is considered that due to the large particle size of an external additive having a particle size of from 100 nm to 500 nm, this external additive tends to easily leave the toner particles and become a free external additive, which leads to the increase in an amount of the external additive required to be cleaned on an image holding member, hence cleaning properties deteriorate.

Meanwhile, in a case of external additives having a distorted shape (referred to as irregular external additives collectively) such as a shape in which approximately spherical particles are lined up (referred to as a snowman shape for convenience) or a shape (referred to as a tetrapod shape for convenience) having convexities protruding in different directions, it is considered that these external additives tend to have more difficulties in moving on toner particles compared to, for example, a spherical external additive. Consequently, it is considered that the change in the structure of the external additive in the toner (1) that is caused by the movement of the external additive on the toner particles is more easily inhibited compared to the spherical external additive, hence the development durability is obtained.

In aggregation and coalescence toner particles that are precisely controlled to minimize irregularity of the shape, the above-described change which is a change in the structure of the external additive of the toner caused by the movement of the external additive on the toner particles tends to greatly influence the development durability easily even if the change is a small change in the structure of the external additive in the toner (1). Therefore, it is considered that the irregular external additive is effective in terms of the development durability.

It is considered that in a case of the snowman-shaped external additive among the irregular external additives, even if rolling of this external additive in one direction may be inhibited, the external additive easily rolls in the other direction. Accordingly, it is considered that this external additive tends to easily move even though the movement is not as easy as that of the spherical external additive.

It is also considered that since the shape of the snowman-shaped external additive easily becomes bulky and easily causes steric hindrance when overlapped, a large amount of the external additive needs to be added to increase the coverage of the external additive to the toner particle surface. Consequently, it is considered that the amount of the free external additive leaving the toner particles tends to increase on the image holding member, and the amount of the external additive required to be cleaned tends to increase, hence cleaning properties deteriorate.

Moreover, it is considered that in a case of a tetrapod-shaped external additive, though the tendency of easy movement is inhibited since rolling of the tetrapod shape is more difficult compared to the snowman shape, these shapes share a common point that they easily become bulky and cause steric hindrance when overlapped, hence cleaning properties deteriorate.

In this respect, the toner (1) according to the present exemplary embodiment employs an irregular external additive having a large particle size and a plate-like flake structure, as an external additive for the toner particles obtained in the specific preparation method described above.

It is considered that since the external additive of the toner (1) according to the present exemplary embodiment has a large particle size, the change in the structure of the external additive in the toner is inhibited as described above, hence development durability is obtained.

In addition, since the external additive of the toner (1) according to the present exemplary embodiment does not easily roll due to its plate-like flake structure, the tendency of easy movement that the snowman-shaped external additive may have is avoided.

It is also considered that due to the plate-like flake structure, only a specific plane of the external additive widens, and the area on the toner particles covered with one external additive widens since the wide plane contacts the toner particles, hence a coverage of the external additive is increased with a small amount of the external additive covering the toner particles.

In addition, it is considered that since the coverage of the external additive is increased with a small amount of the external additive, the tendency that the external additive such as the snowman-shaped or tetrapod-shaped external additive needs to be added in a large amount to a toner is avoided, and the free external additive leaving the toner tends to be reduced. Consequently, it is considered that the amount of the external additive required to be cleaned on the image holding member is reduced, hence excellent cleaning properties are obtained.

It is considered that the toner (1) according to the present exemplary embodiment has development durability and excellent cleaning properties for the above reasons.

In addition, it is considered that when the external additive has a spherical shape, since this external additive easily slips through cleaning (particularly, a cleaning blade) and remains on the image holding member, image defect such as deletion is easily caused. However, it is considered that in a case of the external additive having a plate-like flake structure, much of this external additive is caught by the cleaning blade portion even if the external additive is in a free state, hence this external additive is inhibited from slipping through as the spherical external additive.

The deletion refers to a phenomenon in which a toner is not attached to a site which is supposed to be an image by a toner attached thereto, and the site becomes a blank in place of the deleted image.

It is also considered that if the coverage of the external additive which covers the toner particles is increased, transfer efficiency of the toner (1) is improved, and that durability of the transfer efficiency is obtained by setting the particle size of the external additive to 100 nm or greater.

The electrostatic charge image developing toner (hereinbelow, simply referred to as a "toner (2)" in some cases) according to the present exemplary embodiment includes toner particles (hereinbelow, referred to as kneaded and pulverized toner particles in some cases) which are obtained by kneading and pulverizing a material including a binder resin and a release agent and an external additive which is silica particles having an average diameter of from 100 nm to 500 nm, an average circularity of from 0.5 to 0.85, and an average of a ratio (Da/H) of a circle-equivalent diameter Da obtained by plane image analysis to a maximum height H obtained by 3-D image analysis of greater than 1.5 and less than 1.9.

The kneaded and pulverized toner particles are obtained by kneading and pulverizing a material including a binder resin and a release agent. Accordingly, the release agent is present in the pulverized interface and exposed on the surface of the kneaded and pulverized toner particles.

Consequently, it is considered that when the toner (2) including the kneaded and pulverized toner particles is used, toners are easily non-electrostatically attached to each other via the release agent, or the toner is easily non-electrostatically attached to the image holding member via the release agent. Accordingly, the transfer efficiency tends to be decreased, or a photoreceptor tends to be contaminated by being rubbed against the cleaning blade in a cleaning portion.

Examples of methods of inhibiting the attachment caused by the release agent exposed on the toner particle surface include externally adding an external additive having an average diameter of 100 nm or more. However, such an external additive easily leaves the toner particles, and this tends to cause photoreceptor contamination called filming (attachment of a toner to a photoreceptor) since the external additive slips through the cleaning portion.

It is considered that such a phenomenon tends to easily occur particularly when the shape of an external additive is approximately spherical.

It is also considered that since the approximately spherical external additive rolls easily, this external additive easily becomes localized on the kneaded and pulverized toner particles having many concavities and convexities on the surface thereof, and a large amount of the external additive needs to be added to cover the toner particles. Consequently, it is considered that the free external additive leaving the toner (2) tends to be increased, and the amount of the external additive required to be cleaned on the image holding member is also increased, hence cleaning properties deteriorate.

In addition, it is considered that the approximately spherical external additive rolls on the toner particles, is attached to the site where the release agent is exposed, and covers the release agent, whereby this external additive easily makes the release agent fail to function. Consequently, it is considered that since a high offset temperature at the time of fixing the toner (2) is decreased for the above reason, the fixing temperature range tends to be narrowed, but the phenomenon of covering the release agent tends to occur increasingly as the amount of the external additive is increased.

On the other hand, if the external additive has an irregular shape, this external additive has more difficulties in rolling on the toner particles compared to the approximately spherical external additive, so the problems described above tend to be improved.

However, the irregular external additive easily becomes bulky, and its shape easily causes steric hindrance if overlapped. Accordingly, in order to improve the coverage of the external additive, a large amount of the external additive needs to be added.

It is also considered that if a large amount of the external additive is added, cleaning properties tend to deteriorate since the external additive leaving the toner particles is increased, and the fixing temperature range of the toner tends to be narrowed (fixing defectiveness is not inhibited particularly in a high temperature range) since the release agent that fails to function by being covered with the external additive is increased.

Therefore, the toner (2) according to the present exemplary embodiment employs irregular silica particles having a large particle size and a plate-like flake structure, as an external additive for the kneaded and pulverized toner particles.

It is considered that since the particle size of the external additive of the toner (2) according to the present exemplary embodiment is large, the attachment caused by the release agent on the toner particle surface is inhibited as described above.

It is also considered that since the external additive of the toner (2) according to the present exemplary embodiment does not easily roll on the toner particles due its plate-like flake structure, the external additive is not easily localized compared to a case of using a spherical external additive even in the kneaded and pulverized toner particles having many concavities and convexities on the surface thereof, hence the above-described deterioration of cleaning properties caused by the addition of a large amount of the external additive is inhibited.

Moreover, since the external additive does not easily roll, the tendency of narrowing of the fixing temperature range of the toner that is caused when the rolling external additive is trapped in the release agent preferentially and covers the release agent is inhibited.

In addition, it is considered that since this external additive has a plate-like flake structure among the irregular external additives, a specific plane of the external additive widens, and when this wide plane contacts the toner particles, the area on the toner particles covered with one external additive widens. Consequently, it is considered that even if the toner particles are covered with a small amount of the external additive, the coverage of the toner particles tends to be increased.

That is, it is considered that since the coverage of the toner particles is increased with a small amount of the external additive, the external additive does not need to be added in a large amount to the toner, unlike the thick irregular external additive.

As a result, since the free external additive leaving the toner is reduced, the amount of the external additive required to be cleaned on the image holding member tends to be reduced, and excellent cleaning properties tend to be obtained. Moreover, the tendency of narrowing of the fixing temperature range of the toner that is caused by the decrease in the release agent which fails to function by being covered with the external additive is inhibited.

For the above reason, it is considered that the toner (2) according to the present exemplary embodiment has excellent cleaning properties and a wide range of fixing temperature, hence the occurrence of fixing defectiveness in a high temperature range is inhibited.

Furthermore, it is considered that since the toner (2) according to the present exemplary embodiment includes the external additive described above, the coverage of the toner particles is increased, and the structure of the external additive is stabilized, hence development durability and transfer durability are obtained.

Hereinbelow, the constitution of the toner according to the present exemplary embodiment will be described in detail.

External Additive

The external additive included in the toner according to the present exemplary embodiment is silica particles having an average diameter of from 100 nm to 500 nm, an average circularity of from 0.5 to 0.85, and an average of a ratio of a circle-equivalent diameter Da obtained by plane image analysis to a maximum height H obtained by 3-D image analysis of greater than 1.5 and less than 1.9.

Hereinbelow, the silica particles as the external additive will be described.

Average Diameter

The silica particles have an average diameter of from 100 nm to 500 nm.

It is considered that if the average diameter of the silica particles is from 100 nm to 500 nm, the silica particles are inhibited from being embedded in the toner particles.

It is also considered that if the average diameter of the silica particles is 100 nm or more, the particle shape does not easily become spherical but easily becomes a shape having a circularity of from 0.5 to 0.85. In addition, it is considered that when the toner particles are covered with the silica particles, the silica particles tend to be easily dispersed on the toner particle surface.

It is considered that if the average diameter of the silica particles is 500 nm or less, the silica particles are not easily lost when a mechanical load is applied to the silica particles, the strength of toner particles tends to be increased when the toner particles are covered with the silica particles, and fluidity of the toner particles to which the silica particles are attached is easily enhanced.

The average diameter of the silica particles is preferably from 100 nm to 350 nm, and more preferably from 100 nm to 250 nm.

The average diameter of silica complex particles refers to a circle-equivalent average diameter which is a diameter accounting for 50% (D50v) of a cumulative frequency of a circle-equivalent diameter that is obtained by dispersing silica complex particles in resin particles (polyester, a weight average molecular weight Mw=50000) having a particle size of 100 μm, observing the thus obtained 100 primary particles by an SEM (Scanning Electron Microscope) instrument, and performing image analysis on the primary particles.

Average Circularity

The average circularity of the silica particles is from 0.5 to 0.85.

It is considered that if the average circularity is 0.85 or less, the shape becomes far from a spherical shape, whereby the silica particles tend not to easily roll on the toner particles, and the structural change of the external additive in the toner is inhibited when the silica particles are added to the toner particles.

In addition, when the silica particles are prepared by a sol-gel method, the silica particles are easily prepared if the average circularity is 0.5 or more.

The average circularity of the silica particles is preferably from 0.6 to 0.8.

The silica particles having been externally added to the toner particles are observed by the SEM instrument, and the thus obtained silica particles are subjected to planar image analysis, whereby the circularity of the silica particles are obtained as "100/SF2" calculated from the following Formula (1).

$$\text{Circularity } (100/SF2) = 4\pi \times (A/I^2) \qquad \text{Formula (1)}$$

In Formula (1), I represents a perimeter of the silica particles in an image, and A represents a projected area of the silica particles.

The average circularity of the silica particles is obtained as a circularity accounting for 50% of the cumulative frequency of the circularity of 100 silica particles obtained by the plane image analysis described above.

Average of Ratio (Da/H) of Circle-Equivalent Diameter Da Obtained by Plane Image Analysis to Maximum Height H Obtained by 3-D Image Analysis In the present silica particles, an average of a ratio (Da/H) of "a circle-equivalent diameter Da obtained by plane image analysis" to "a maximum height H obtained by 3-D image analysis" is greater than 1.5 and less than 1.9.

The average of Da/H is an average of Da/H of each of the silica particles that is obtained by measuring Da and H for each of the silica particles.

Since the average of Da/H in the toner (1) according to the exemplary embodiment of the present invention is greater than 1.5, the shape of the silica particles becomes close to a plate-like flake structure, and the coverage of the silica is increased with a small amount of the silica particles covering the toner particles as described above. Therefore, it is considered that since only a small amount of the silica particles are added to the toner (1), the number of silica particles leaving the toner tends to be decreased, hence the amount of the silica particles required to be cleaned on the image holding member is reduced.

Consequently, the toner (1) has excellent cleaning properties.

Since the average of Da/H in the toner (2) according to the exemplary embodiment of the present invention is greater than 1.5, the shape of the silica particles becomes close to the plate-like flake structure. Accordingly, as described above, the coverage of the toner particles is increased with a small amount of the silica particles covering the toner particles, and only a small amount of the silica particles are added to the toner (2). As a result, the amount of the release agent which fails to function by being covered with the external additive and has the shape of toner particles is decreased, hence the tendency of narrowing of the fixing temperature range of the toner (2) is inhibited.

Furthermore, it is considered that since only a small amount of the silica particles are added to the toner (2), the number of silica particles leaving the toner (2) tends to be decreased, whereby the amount of the silica particles required to be cleaned on the image holding member is reduced.

As a result, the toner (2) has excellent cleaning properties and a wide range of fixing temperatures, and the occurrence of fixing defectiveness in a high temperature range is inhibited.

It is also considered that since the average of Da/H is greater than 1.5, the silica particles are inhibited from having a structure easily receiving an external mechanical load due to the increase in the height H of the silica particles, hence the fluidity of the toner particles may be maintained.

In addition, it is considered that if the average of Da/H is less than 1.9, the shape of the silica particles are inhibited from becoming close to a scale shape, which leads to inhibition of deterioration of fluidity of the toner particles caused by loss of silica particles that is easily caused when a mechanical load is applied to the silica particles.

The average of Da/H is preferably from 1.6 to 1.85, and more preferably from 1.65 to 1.8.

The maximum height H and the circle-equivalent diameter Da of the silica particles are obtained by the following sequence.

For the silica particles having been externally added to the toner particles, the height in an X-Y axis direction is analyzed every 10 nm in a visual field at 10,000× magnification by using an electron beam 3-D roughness analyzer (ERA-8900 manufactured by ELIONIX INC.) so as to obtain the height, and in the same visual field, 2-D images are captured at 10,000× magnification.

Subsequently, the 2-D images are used to obtain an area calculated under a condition of 0.010000 μm/pixel by using image analysis software WinROOf (manufactured by MITANI CORPORATION), and the circle-equivalent diameter Da is obtained from this area by the following Formula (2), whereby each particle is numbered with a particle number.

$$\text{Circle-equivalent diameter}=2\sqrt{(\text{area}/\pi)} \qquad \text{Formula (2)}$$

The analyzed numerical values of the height are made into images by conditional formatting (two-color scale) by using spread sheet software Microsoft Excel (Microsoft) so as to be matched with the particle number of each particle, thereby determining the maximum height H of each particle number for individual particle.

The average of Da/H is an average of 100 silica particles measured.

The amount of the silica particles added externally is, for example, preferably from 0.1 part by weight to 3.0 parts by weight, more preferably from 0.3 part by weight to 2.0 parts by weight, and even more preferably from 0.5 part by weight to 1.8 parts by weight, based on 100 parts by weight of the toner particles.

Components and Surface Treatment

The silica particles may be crystalline or amorphous particles including silica, that is, $SiO_2$ as a main component. Moreover, the silica particles may be particles that are prepared using a silicon compound such as liquid glass or alkoxy silane as a raw material or particles that are obtained by pulverizing quartz.

It is preferable that the silica particles are treated with a hydrophobizing agent in view of the dispersibility of the silica particles. For example, by coating the silica particle surface with an alkyl group, the silica particles are hydrophobized. For doing this, for example, a known organic silicon compound having an alkyl group may be allowed to act on the silica particles. The method of hydrophobizing treatment will be described later in detail.

Method of Preparing Silica Particles

The method of preparing silica particles is not particularly limited as long as the silica particles obtained by the method have an average diameter in the range of 100 nm to 500 nm, an average circularity in the range of 0.5 to 0.85, and an average of a ratio of a circle-equivalent diameter Da obtained by plane image analysis to a maximum height H obtained by 3-D image analysis of greater than 1.5 and less than 1.9.

For example, the silica particles may be obtained by a dry method that pulverizes silica particles having a particle size of greater than 500 nm and classifies the particles or by a so-called wet method that generates the particles by a sol-gel method by using a silicon compound represented by alkoxy silane as a raw material. As the wet method, there is a method of obtaining silica sol by using liquid glass as a raw material, in addition to the sol-gel method.

An example of the method of preparing silica particles includes the following preparation method.

The method of preparing silica particles is constituted with a step of preparing an alkaline catalyst solution containing an alkaline catalyst in a solvent containing alcohol; a first supply step in which tetraalkoxysilane and an alkaline catalyst are supplied to the alkaline catalyst solution until the amount of the tetraalkoxysilane supplied becomes 0.002 mol/mol to 0.008 mol/mol based on the amount of the alcohol in the preparation step; a step of stopping supply in which the supply of the tetraalkoxysilane and the alkaline catalyst is stopped for 0.5 min to 10 min after the first supply step; and a second supply step in which the tetraalkoxysilane and the alkaline catalyst are further supplied to the alkaline catalyst solution after the step of stopping supply.

That is, the method of preparing silica particles according to the present exemplary embodiment is a method in which while each of tetraalkoxysilane as a raw material and an alkaline catalyst as a catalyst are being separately supplied in the presence of alcohol containing an alkaline catalyst such that the tetraalkoxysilane is reacted, the supply of the tetraalkoxysilane and the alkaline catalyst is stopped at least once in midstream, and then the supply of those are resumed to generate flake-shape irregular silica particles.

With the method of preparing silica particles according to the present exemplary embodiment, irregular silica particles having an average diameter of from 100 nm to 500 nm, an average of Da/H of greater than 1.5 and less than 1.9, and an average circularity of from 0.5 to 0.85 are obtained by the above technique. Though unclear, the reason is considered to be as below.

First, when the alkaline catalyst solution containing an alkaline catalyst is prepared in the solvent containing alcohol, and tetraalkoxysilane and an alkaline catalyst are each supplied to this solution, the tetraalkoxysilane supplied into the alkaline catalyst solution reacts, whereby nuclear particles are generated. At this time, the alkaline catalyst carries out the catalytic action and is coordinated on the surface of the generated nuclear particles so as to contribute to the shape and dispersion stability of the nuclear particles, but does not evenly cover the nuclear particle surface (that is, the alkaline catalyst is attached to the localized site of the nuclear particle surface). Accordingly, it is considered that though the dispersion stability of the nuclear particles is maintained, surface tension and chemical affinity are concentrated in a portion of the nuclear particles, whereby irregular nuclear particles are generated.

In addition, if the supply of the tetraalkoxysilane and the alkaline catalyst each is continued, the generated nuclear particles grow due to the reaction of the tetraalkoxysilane.

At this time, when the amount of the supplied tetraalkoxysilane reaches the specific concentration described above, the supply of the tetraalkoxysilane and the alkaline catalyst is stopped for the specific time described above, and then the supply is resumed again.

It is considered that by stopping the supply of the tetraalkoxysilane and the alkaline catalyst, the particles in the reaction system are aggregated in a flake shape, though the reason is unclear. It is considered that if the supply of the tetraalkoxysilane and the alkaline catalyst is stopped too early at this time, that is, if the amount of the supplied tetraalkoxysilane is small, the particle concentration in the reaction system is low, so the probability that the particles collide with each other becomes low, whereby aggregation is not easily caused. It is considered that, on the other hand, if the supply of the tetraalkoxysilane and the alkaline catalyst is stopped too late, and the amount of the supplied tetraalkoxysilane is large, the nuclear particles grow too much, so the particles themselves are stabilized and are not aggregated, whereby the flake-shape particles are not formed.

Moreover, if the supply of the tetraalkoxysilane and the alkaline catalyst is stopped for a short time, the amount of the aggregated particles tends to be insufficient, and if the supply is stopped for a long time, the particles tend to be aggregated too much and become a gel state.

It is also considered that by promoting the particle growth by making flake-shape irregular silica particles in the step of stopping supply and by resuming the supply of the tetraalkoxysilane and the alkaline catalyst, the irregular silica particles having a flake shape in which an average of Da/H is greater than 1.5 and less than 1.9, an average diameter of from 100 nm to 500 nm, and an average circularity of from 0.5 to 0.85 are obtained.

In addition, it is considered that in the above method of preparing silica particles, since the irregular nuclear particles are caused to grow, and the nuclear particles are caused to grow while maintaining the irregularity to generate the silica particles, the irregular silica particles having high shape stability against a mechanical load are obtained.

Furthermore, it is considered that in the above method of preparing silica particles, since the generated irregular nuclear particles are caused to grow while maintaining the irregularity, and the silica particles are obtained in this manner, the silica particles that are resistant to the mechanical load and are not easily broken are obtained.

Moreover, in the above method of preparing silica particles, the tetraalkoxysilane and the alkaline catalyst are each supplied into the alkaline catalyst solution so as to cause the reaction of the tetraalkoxysilane, whereby the particles are generated. Consequently, the total amount of the used alkaline catalyst is reduced compared to a case of preparing the irregular silica particles by the sol-gel method used in the related art, which makes it possible to skip a step of removing the alkaline catalyst. This is particularly useful when silica particles are applied to products requiring high purity.

Hereinbelow, the method of preparing silica particles will be described in detail.

The method of preparing silica particles are largely divided into two steps. One of the steps is a step of preparing an alkaline catalyst solution (preparation step), and the other is a step of generating silica particles by supplying tetraalkoxysilane and an alkaline catalyst to the alkaline catalyst solution (particle generation step).

The particle generation step is further divided at least into 3 stages which include a first supply step in which the tetraalkoxysilane and the alkaline catalyst are supplied to the alkaline catalyst solution to begin the generation of silica particles, a step of stopping supply (also referred to as maturation step) in which the supply of the tetraalkoxysilane and the alkaline catalyst is stopped, and a second supply step in which the supply of the tetraalkoxysilane and the alkaline catalyst is resumed.

Preparation Step

In the preparation step, an alcohol-containing solvent is prepared, and an alkaline catalyst is added thereto, thereby preparing an alkaline catalyst solution.

The alcohol-containing solvent may be a solvent containing only an alcohol. Optionally, the solvent may be a mixed solvent containing other solvents such as water; ketones such as acetone, methyl ethyl ketone, and methyl isobutyl ketone; cellosolves such as methyl cellosolve, ethyl cellosolve, butyl cellosolve, and cellosolve acetate; and ethers such as dioxane and tetrahydrofuran. In a case of the mixed solvent, the amount of alcohol relative to the other solvent is preferably 80% by weight or more (more preferably 90% by weight or more).

Examples of the alcohol include lower alcohols such as methanol and ethanol.

The alkaline catalyst is a catalyst for promoting the reaction (a hydrolysis reaction and a condensation reaction) of the tetraalkoxysilane. Examples of the catalyst include basic catalysts such as ammonia, urea, monoamine, a quaternary ammonium salt, and ammonia is particularly preferable.

The concentration (content) of the alkaline catalyst is preferably from 0.6 mol/L to 0.85 mol/L, and more preferably from 0.63 mol/L to 0.78 mol/L, and even more preferably from 0.66 mol/L to 0.75 mol/L.

If the concentration of the alkaline catalyst is 0.6 mol/L or more, when the tetraalkoxysilane is supplied in the particle generation step, dispersibility of the generated nuclear particles in the growth process is stabilized, and the generation of coarse aggregation substances such as a secondary aggregation substance is inhibited, whereby the nuclear particles may be inhibited from being a gel-like substance.

On the other hand, if the concentration of the alkaline catalyst is more than 0.85 mol/L, the generated nuclear particles are excessively stabilized, and perfectly spherical nuclear particles are generated. Accordingly, the irregular nuclear particles having an average circularity of 0.85 or less are not obtained, so the irregular silica particles are not obtained.

The concentration of the alkaline catalyst is a concentration with respect to an alcohol catalyst solution (an alkaline catalyst and alcohol-containing solvent).

Particle Generation Step

Next, the particle generation step will be described.

The particle generation step is a step of generating silica particles by supplying the tetraalkoxysilane and the alkaline catalyst each into the alkaline catalyst solution and causing the reaction (a hydrolysis reaction and a condensation reaction) of the tetraalkoxysilane in the alkaline catalyst solution. In the method of preparing silica particles according to the present exemplary embodiment, during the particle growth performed in this manner, the supply of components added is stopped so as to aggregate the particles, thereby forming flake-shape irregular particles.

First Supply Step

The first supply step is a step of supplying the tetraalkoxysilane and the alkaline catalyst into the alkaline catalyst solution. The tetraalkoxysilane is supplied until the concentration becomes 0.002 mol/mol to 0.008 mol/mol, based on the amount of the alcohol in the preparation step.

The "concentration of from 0.002 mol/mol to 0.008 mol/mol based on the amount of the alcohol in the preparation step" refers to "a concentration of from 0.002 mol to 0.008 mol based on a unit molar amount (1 mol) of the alcohol in the alkaline catalyst solution prepared in the preparation step".

If the amount of the tetraalkoxysilane supplied in the first supply step is smaller than 0.002 mol/mol based on the amount of alcohol in the alkaline catalyst solution prepared in the preparation step, the particle concentration in the process of nuclear particle formation becomes low. Accordingly, coalescence is not caused between the particles, and particles having low irregularity are formed, whereby flow durability deteriorates.

On the other hand, if the amount of the tetraalkoxysilane supplied is more than 0.008 mol/mol based on the amount of alcohol in the alkaline catalyst solution prepared in the preparation step, the nuclear particles are stabilized. Accordingly, coalescence is not caused between the particles, and particles having low irregularity are formed, whereby flow durability deteriorates.

The amount of the tetraalkoxysilane supplied in the first supply step is preferably from 0.003 mol/mol to 0.008 mol/mol, and more preferably from 0.006 mol/mol to 0.008 mol/mol, based on the amount of alcohol in the alkaline catalyst solution prepared in the preparation step.

As the tetraalkoxysilane supplied into the alkaline catalyst solution, for example, a silane compound such as a quadrifunctional silane compound may be used.

Specific examples of the tetraalkoxysilane include tetramethoxysilane, tetraethoxysilane, tetrapropoxysilane, tetrabutoxysilane, and the like, and among these, tetramethoxysilane and tetraethoxysilane are preferable in terms of controllability of the reaction rate and the shape, particle size, particle size distribution, and the like of the obtained silica particles.

In the first supply step, nuclear particles are formed due to the reaction of the tetraalkoxysilane in the initial stage of the supply of the tetraalkoxysilane and the alkaline catalyst (stage of forming nuclear particles), and then the supply is further continued to cause the nuclear particles to grow (stage of nuclear particle growth).

As describe above, in the alkaline catalyst solution to which the tetraalkoxysilane and the alkaline catalyst are supplied, the concentration (content) of the alkaline catalyst is preferably from 0.6 mol/L to 0.85 mol/L.

Accordingly, the first supply step preferably includes a step of forming nuclear particles in which the nuclear particles are formed by supplying the tetraalkoxysilane and the alkaline catalyst into the alkaline catalyst solution that contains the alkaline catalyst at a concentration of from 0.6 mol/L to 0.85 mol/L. A preferable range of the concentration of the alkaline catalyst in the alkaline catalyst solution is as described above.

The supply rate of the tetraalkoxysilane is preferably from 0.001 mol/(mol·min) to 0.010 mol/(mol·min), based on the alcohol in the alkaline catalyst solution.

The supply rate means that the tetraalkoxysilane is supplied in an amount of from 0.001 mol to 0.010 mol per minute with respect to 1 mol of the alcohol used in the step of preparing the alkaline catalyst solution.

If the supply rate of the tetraalkoxysilane is within the above range, the irregular silica particles having an average circularity of from 0.5 to 0.85 are easily generated at a high rate (for example, 95% in terms of the number of the particles).

In addition, regarding the particle size of the silica particles, if the amount of the supplied tetraalkoxysilane used in the reaction of generating particles is set to, for example, 1.08 mol or more based on 1 L of a silica particle dispersion, primary particles having a particle size of 100 nm or more are obtained, and if the amount is set to 5.49 mol or less based on 1 L of the silica particle dispersion, primary particles having a particle size of 500 nm or less are obtained, though the particle size also depends on the type of the tetraalkoxysilane and the reaction conditions.

It is considered that if the supply rate of the tetraalkoxysilane is smaller than 0.001 mol/(mol·min), the tetraalkoxysilane may be evenly supplied to the nuclear particles before the reaction is caused between the nuclear particles and the tetraalkoxysilane, so silica particles having similar shapes in which both the particle size and the shape do not show uneven distribution are generated.

If the supply rate of the tetraalkoxysilane is 0.010 mol/(mol·min) or less, the amount of the tetraalkoxysilane supplied in the reaction between tetraalkoxysilanes in the stage of forming nuclear particles or the reaction between the tetraalkoxysilane and the nuclear particles during the particle growth does not become excessive, and the reaction system is not easily gelated, whereby the nuclear particle formation and the particle growth are not easily hindered.

The supply rate of the tetraalkoxysilane is preferably from 0.0065 mol/(mol·min) to 0.0085 mol/(mol·min), and more preferably from 0.007 mol/(mol·min) to 0.008 mol/(mol·min).

Examples of the alkaline catalyst supplied into the alkaline catalyst solution include the catalysts exemplified above. The alkaline catalyst supplied may be the same type as or the different type from the alkaline catalyst that is already contained in the alkaline catalyst solution, but it is preferable that the catalysts be the same type.

The amount of the alkaline catalyst supplied is preferably from 0.1 mol to 0.4 mol, more preferably from 0.14 mol to 0.35 mol, and even more preferably from 0.18 mol to 0.30 mol, based on 1 mol of the total amount of the tetraalkoxysilane supplied per minute.

If the amount of the alkaline catalyst supplied is 0.1 mol or more, dispersibility of the generated nuclear particles in the process of growth is stabilized, whereby a coarse aggregation substance such as a secondary aggregation substance is not easily generated, and gelation of the particles is inhibited.

On the other hand, if the amount of the alkaline catalyst supplied is 0.4 mol or less, the generated particles does not easily stabilized excessively, whereby the irregular nuclear particles formed in the stage of generating nuclear particles are inhibited from growing into spherical particles in the stage of nuclear particle growth.

Step of Stopping Supply (Maturation Step)

After the tetraalkoxysilane and the alkaline catalyst are supplied by the first supply step until the tetraalkoxysilane reaches the above-described concentration, in the step of stopping supply, the supply of the tetraalkoxysilane and the alkaline catalyst is stopped for 0.5 min to 10 min.

The step of stopping supply is in other words a maturation step that allows the particles to mature by stopping once the supply of the tetraalkoxysilane and the alkaline catalyst so as to promote the aggregation of the nuclear particles.

In the maturation step, if the time of stopping the supply of the tetraalkoxysilane and the alkaline catalyst is 0.5 min or longer, the particles coalesce sufficiently, whereby particles having high irregularity are formed.

In the maturation step, if the time of stopping the supply of the tetraalkoxysilane and the alkaline catalyst is 10 min or shorter, deterioration of dispersibility of the particles caused by the excessive coalescence of the particles is inhibited.

In the maturation step, the time of stopping the supply of the tetraalkoxysilane and the alkaline catalyst is preferably from 0.6 min to 5 min, and more preferably from 0.8 min to 3 min.

Second Supply Step

The second supply step is a step of further supplying the tetraalkoxysilane and the alkaline catalyst after the step of stopping supply. By resuming the supply of the tetraalkoxysilane and the alkaline catalyst that is stopped in the step of stopping supply, the aggregated nuclear particles are caused to further grow, whereby the average diameter of the flake-shape irregular silica particles are further increased.

In the second supply step, the preferable range of the concentration and the amount of the tetraalkoxysilane supplied to the reaction system and the preferable range of the concentration and the amount of the alkaline catalyst supplied are the same as in the first supply step.

In the second supply step, the concentration and the amount of the tetraalkoxysilane supplied to the reaction system and the concentration and the amount of the alkaline catalyst supplied may be different from the concentration and the amount of the tetraalkoxysilane supplied to the reaction system and the concentration and the amount of the alkaline catalyst supplied in the first supply step.

In the step of generating particles (including the first supply step, the maturation step, and the second supply step), the temperature (temperature at the time of the supply) of the alkaline catalyst solution is preferably, for example, from 5° C. to 50° C., and more preferably from 15° C. to 40° C.

In addition, in the present method of preparing silica particles, after the second supply step, the step of stopping supply may be performed once or more, or a supply step that supplies the tetraalkoxysilane and the alkaline catalyst may be performed again.

The silica particles are obtained through the above steps. Though the silica particles obtained in this state is in a state of a dispersion, the silica particles may be used as is as the silica particle dispersion, or may be used by being collected as powder of the silica particles after removing the solvent.

When the silica particles are used as the silica particle dispersion, the dispersion may be optionally diluted with water or alcohol or concentrated so as to adjust the concentration of the solid content of the silica particles. Moreover, the silica particle dispersion may be used after the solvent is substituted with, for example, other water-soluble organic solvents such as alcohols, esters, and ketones.

On the other hand, when the silica particles are used as the powder, it is necessary to remove the solvent from the silica particle dispersion. Examples of the method of removing the solvent include known methods such as 1) a method of removing the solvent by filtration, centrifugation, distillation, or the like, and then drying the resultant by a vacuum drier, a shelf drier, or the like, and 2) a method of directly drying slurry by a fluidized bed drier, a spray drier, or the like. Though not particularly limited, the drying temperature is preferably 200° C. or lower. If the drying temperature is higher than 200° C., silanol groups remaining on the silica particle surface are condensed, whereby the primary particles are easily combined, or coarse particles are easily generated.

The dried silica particles may optionally be crushed and sieved so as to remove the coarse particles or the aggregation substance. Though not particularly limited, the method of crushing is performed by, for example, a dry-pulverizing device such as a jet mill, a vibration mill, a ball mill, or pin mill. The method of sieving is implemented by, for example, a known device such as a vibration sieve or a wind classifier.

The silica particles obtained by the present preparation method may be used after the silica particle surface is treated with a hydrophobizing agent.

Examples of the hydrophobizing agent include known organic silicon compounds having an alkyl group (for example, a methyl group, an ethyl group, a propyl group, a butyl group, and the like). Specific examples of the agent include (for example, silane compounds such as methyltrimethoxysilane, dimethyldimethoxysilane, trimethylchlorosilane, and trimethylmethoxysilane) and silazane compounds (for example, hexamethyldisilazane, and tetramethyldisilazane) and the like. One kind of the hydrophobizing agent may be used, or plural kinds thereof may be used.

Among these hydrophobizing agents, organic silicon compounds having a trimethyl group, such as methyltrimethoxysilane and hexamethyldisilazane, are suitable.

The amount of the hydrophobizing agent used is not particularly limited, but in order to obtain the hydrophobizing effect, the amount is, for example, from 1% by weight to 100% by weight, and preferably from 5% by weight to 80% by weight, based on the silica particles.

The method of obtaining a dispersion of hydrophobic silica particles having been treated with the hydrophobizing agent include a method in which the hydrophobizing agent is added in a necessary amount to the silica particle dispersion and reacted at a temperature in the range of 30° C. to 80° C. under stirring such that the silica particles are subjected to the hydrophobizing treatment, thereby obtaining the hydrophobic silica particle dispersion. If the reaction temperature is lower than 30° C., the hydrophobizing reaction does not easily proceed, and if the temperature is higher than 80° C., for example the dispersion is easily gelated due to the self condensation of the hydrophobizing agent, or the silica particles are easily aggregated in some case.

Examples of the method of obtaining powdered hydrophobic silica particles include a method of obtaining powder of the hydrophobic silica particles by obtaining the hydrophobic silica particle dispersion in the above method and then drying the dispersion by the above method; a method of obtaining powder of the hydrophobic silica particles by obtaining the powder of the hydrophilic silica particles by drying the silica particle dispersion and then adding the hydrophobizing agent to perform the hydrophobizing treatment; a method of obtaining powder of the silica particles by obtaining powder of the hydrophobic silica particles by performing drying after the hydrophobic silica particle dispersion is obtained and then further adding the hydrophobizing agent to perform the hydrophobizing treatment; and the like.

Examples of the method of performing hydrophobizing treatment on the powdered silica particles include a method including stirring the powdered hydrophilic silica particles in a treatment tank such as a Henschel mixer or a fluidized bed, adding a hydrophobizing agent to the tank, and heating the inside of the treatment tank to gasifying the hydrophobizing agent such that the agent is allowed to react with silanol groups on the surface of the powdered silica particles. Though not particularly limited, the treatment temperature is, for example, from 80° C. to 300° C., and preferably from 120° C. to 200° C.

Toner Particles

Next, toner particles of the toner (1) according to the exemplary embodiment of the present invention will be described.

The toner particles of the toner (1) according to the exemplary embodiment of the present invention include a binder resin and optionally a colorant, a release agent, and other additives.

The binder resin is not particularly limited, and examples thereof include homopolymers formed of monomers of styrenes such as styrene, para-chlorostyrene, α-methylstyrene; esters having a vinyl group, such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate; vinyl nitriles such as acrylonitrile and methacrylonitrile; vinyl ethers such as vinyl methyl ether and vinyl isobutyl ether; vinyl ketones such as vinyl methyl ketone, vinyl ethyl ketone, and vinyl isopropenyl ketone; and olefins such as ethylene, propylene, and butadiene, copolymers obtained by combining two or more kinds of the above ones, and mixtures of these. The examples also include non-vinyl condensed resins such as an epoxy resin, a polyester resin, a polyurethane resin, a polyamide resin, a cellulose resin, and a polyether resin, mixtures of these resins with the above vinyl resins, graft polymers obtained by polymerizing vinyl monomers in the presence of the non-vinyl condensed resin and the like.

A styrene resin, a (meth)acrylic resin, and a styrene-(meth) acrylic copolymer resin are obtained by, for example, known methods by using styrene monomers and (meth)acrylic acid monomers singly or in an appropriate combination. In addition, the "(meth)acryl" is a term that includes all of "acryl" and "methacryl".

A polyester resin is obtained by being synthesized using a method known in the related art, for example, ester exchange, polycondensation, or the like, by using a combination of suitable components selected from dicarboxylic acid components and diol components.

When the styrene resin, the (meth)acrylic resin, and the copolymer resin of these are used as a binder resin, it is preferable to use the resin having a weight average molecular weight Mw in the range of 20,000 to 100,000 and a number average molecular weight Mn in the range of 2,000 to 30,000. On the other hand, when the polyester resin is used as a binder resin, it is preferable to use the resin having a weight average molecular weight Mw in the range of 5,000 to 40,000 and a number average molecular weight Mn in the range of 2,000 to 10,000.

The glass transition temperature of the binder resin is preferably in the range of 40° C. to 80° C. If the glass transition temperature is within the above range, a minimum fixing temperature is easily maintained.

Colorant

The colorant may be, for example, either a dye or a pigment, but in view of lightfastness and waterfastness, a pigment is preferable.

As the colorant, for example, known pigments such as carbon black, aniline black, aniline blue, calco oil blue, chrome yellow, ultramarine blue, Dupont oil red, quinoline yellow, methylene blue chloride, phthalocyanine blue, malachite green oxalate, lamp black, rose red oxide, quinacridone, benzidine yellow, C.I. Pigment•Red 48:1, C.I. Pigment•Red 57:1, C.I. Pigment•Red 122, C.I. Pigment•Red 185, C.I. Pigment•Red 238, C.I. Pigment•Yellow 12, C.I. Pigment•Yellow 17, C.I. Pigment•Yellow 180, C.I. Pigment•Yellow 97, C.I. Pigment•Yellow 74, C.I. Pigment-Blue 15:1, and C.I. Pigment•Blue 15:3 may be used.

Optionally, a surface-treated colorant or a pigment dispersion may be used as the colorant.

By selecting the type of the colorant, a yellow toner, a magenta toner, a cyan toner, a black toner, and the like are obtained.

The content of the colorant is preferably in the range of 1 part by weight to 30 parts by weight based on 100 parts by weight of the binder resin.

Release Agent

Examples of the release agent include paraffin wax such as low molecular weight polypropylene and low molecular weight polyethylene; silicone resin; rosin; rice wax; carnauba wax; and the like. The melting temperature of these release agents is preferably from 50° C. to 100° C., and more preferably from 60° C. to 95° C.

The content of the release agent is preferably from 0.5 part by weight to 15 parts by weight, and more preferably from 1.0 part by weight to 12 parts by weight, based on 100 parts by weight of the binder resin.

If the content of the release agent is 0.5 part by weight or more, occurrence of peeling defectiveness is prevented particularly in oil-less fixing. If the content of the release agent is 15 parts by weight or less, fluidity of the toner (1) does not deteriorate, and the reliability of images and image formation is improved.

Other Additives

Known agents may be used as a charge-controlling agent, and azo-based metal complex compounds, metal complex compounds of salicylic acid, and resin-type charge-controlling agents containing a polar group may be used.

Characteristics of Toner Particles of Toner (1)

The toner particles of the toner (1) according to the exemplary embodiment of the present invention may be toner particles having a single layer structure or toner particles having a so-called core-shell structure which is constituted with a core portion (core particle) and a coating layer (shell layer) coating the core portion.

The toner particles having a core-shell structure may be constituted with, for example, a core portion including a binder resin (the polyester according to the present exemplary embodiment and a crystalline polyester resin) and optionally other additives such as a colorant and a release agent and a coating layer including a binder resin (polyester according to the present exemplary embodiment).

The volume average particle size of the toner particles is, for example, preferably from 2.0 μm to 10 μm, and more preferably from 3.5 μm to 7.0 μm.

As the method of measuring the volume average particle size of the toner particles, 0.5 mg to 50 mg of a measurement sample is added to 2 ml of an aqueous solution including a surfactant as a dispersant which is preferably 5% by weight of sodium alkylbenzene sulfonate, and this solution is added to 100 ml to 150 ml of an electrolytic solution. This electrolytic solution in which the measurement sample has been suspended is dispersed for 1 minute by an ultrasonic dispersing machine, and particle size distribution of particles having a particle size in the range of 2.0 μm to 60 μm is measured with Coulter Multisizer II model (Beckman. Coulter, Inc.) by using an aperture having an aperture diameter of 100 μm. The number of measured particles is 50,000.

For the particle size ranges (channels) formed by dividing the obtained particle size distribution, the cumulative distribution of volume is created starting from the small size particles, and a particle size reaching cumulative 50% is defined as a volume average particle size D50v.

The shape factor SF1 of the toner particles is, for example, preferably from 110 to 150, and more preferably from 120 to 140.

The above shape factor SF1 is calculated by the following Formula (1).

$$SF1=(ML^2/A)\times(\pi/4)\times 100 \qquad \text{Formula (1)}$$

In the Formula (1), ML represents an absolute maximum length of the toner particles, and A represents a projected area of the toner particles.

SF1 is converted into a numerical value mainly by analyzing microscopic images or images of a scanning electron microscope (SEM) by using an image analyzer and calculated by, for example, the following manner. That is, optical microscopic images of particles dispersed on the slide glass surface are provided to a Luzex image analyzer through a video camera, the maximum length and the projected area of 100 particles are obtained and calculated by the Formula (1), and an average thereof is calculated, thereby obtaining SF1.

Method of Preparing Toner (1)

Hereinbelow, the method of preparing the toner (1) according to the present exemplary embodiment will be described.

First, the toner particles are at least aggregation and coalescence toner particles obtained by an aggregation and coalescence method in which the toner particles are prepared through a step of forming aggregated particles, wherein aggregated particles are formed by aggregating resin particles in a raw material dispersion in which the resin particles are dispersed, and a step of coalescence, wherein the toner particles are formed by causing the aggregated particles to coalesce by heating the aggregated particle dispersion in which the aggregated particles are dispersed.

A specific example of the aggregation and coalescence method will be described below.

In the following description, a method of obtaining toner particles including a colorant and a release agent will be described, but the colorant and the release agent are added optionally. Needless to say, additives other than the colorant and the release agent may also be used.

Step of Preparing Resin Particle Dispersion

First, in addition to a resin particle dispersion in which the polyester resin particles as a binder resin are dispersed, for example, a colorant particle dispersion in which colorant particles are dispersed and a release agent dispersion in which release agent particles are dispersed are prepared.

The resin particle dispersion is prepared by, for example, dispersing the polyester resin particles as a binder resin in a dispersion medium by using a surfactant.

Examples of the dispersion medium used for the resin particle dispersion include aqueous media.

Examples of the aqueous media include water such as distilled water and deionized water, alcohols, and the like. One kind of these media may be used alone, or two or more kinds thereof may be concurrently used.

The surfactant is not particularly limited, and examples thereof include anionic surfactants such as a sulfuric acid ester salt-based surfactant, a sulfonic acid salt-based surfactant, a phosphoric acid ester-based surfactant, and a soap-based surfactant; cationic surfactants such as an amine salt type surfactant and a quaternary ammonium salt type surfactant; nonionic surfactants such as a polyethylene glycol-based surfactant, an alkylphenol ethylene oxide adduct-based surfactant, and a polyol-based surfactant; and the like. Among these, anionic and cationic surfactants are particularly exemplified. The nonionic surfactant may be used concurrently with the anionic or cationic surfactant.

One kind of the above surfactants may be used alone, or two or more kinds thereof may be used concurrently.

Examples of the method of dispersing the polyester resin particles as a binder resin in a dispersion medium in the resin particle dispersion include general dispersion methods using a rotating shear type homogenizer, a ball mill including media, a sand mill, a dyno mill, or the like. Moreover, depending on the type of the resin particles used, the resin particles may be dispersed in the resin particle dispersion by using, for example, a phase inversion emulsification method.

The phase inversion emulsification method is a method in which a resin to be dispersed is dissolved in a hydrophobic organic solvent that is able to dissolve the resin, a base is then added thereto in an organic continuous phase (O phase) to neutralize the solution, and then an aqueous medium (W phase) is added to the resultant. In this manner, the resin is converted from W/O to O/W (so-called phase inversion) and becomes a discontinuous phase, whereby the resin is dispersed in the shape of particles.

The volume average particle size of the polyester resin particles as a binder resin to be dispersed in the resin particle dispersion is, for example, in the range of 0.01 μm to 1 μm, and may be in the range of 0.08 μm to 0.8 μm or in the range of 0.1 μm to 0.6 μm.

The volume average particle size of the resin particles is measured by laser diffraction type particle size distribution analyzer (LA-920 manufactured by HORIBA, Ltd.). In the following description, the volume average particle size of the resin particles is measured in the same manner unless otherwise specified.

The content of the polyester resin particles included in the resin particle dispersion is, for example, from 5% by weight to 50% by weight, and may be 10% by weight to 40% by weight.

In addition, for example, a colorant dispersion and a release agent dispersion are prepared in the same manner as the resin particle dispersion. That is, the volume average particle size, dispersion medium, dispersion method, and content of particles in the resin particle dispersion are the same as those of colorant particles dispersed in the colorant dispersion and release agent particles dispersed in the release agent dispersion.

Step of Forming Aggregated Particles

Next, the resin particle dispersion is mixed with the colorant particle dispersion and the release agent dispersion.

Subsequently, the polyester resin particles as a binder resin, the colorant particles, and the release agent particles are aggregated in the mixed dispersion by heteroaggregation, thereby forming aggregated particles which include the polyester resin particles, the colorant particles, and the release agent particles and have a size close to the target size of the toner particles.

Specifically, for example, an aggregating agent is added to the mixed dispersion, pH of the mixed dispersion is adjusted to be acidic (for example, pH of from 2 to 5), and optionally a dispersion stabilizer is added thereto. Thereafter, the mixed dispersion is heated at a temperature corresponding to the glass transition temperature of the polyester resin particles (specifically, for example, from a temperature 30° C. lower than the glass transition temperature of the polyester resin particles to a temperature 10° C. lower than the glass transition temperature of the polyester resin particles) as a binder resin to aggregate the particles dispersed in the mixed dispersion, thereby forming aggregated particles.

In the step of forming aggregated particles, for example, the above aggregating agent is added at room temperature (for example, 25° C.) while the mixed dispersion is being starred with a rotating shear type homogenizer, pH of the mixed dispersion is adjusted to be acidic (for example, pH of from 2 to 5), the dispersion stabilizer is optionally added thereto, and then the heating may be performed.

Examples of the aggregating agent include surfactants having a polarity opposite to that of surfactants used as the dispersant added to the mixed dispersion, such as an inorganic metal salt and a metal complex having a valency of 2 or higher. Particularly, when the metal complex is used as the aggregating agent, the amount of the surfactant used is reduced, and the charging characteristics are improved.

An additive that forms a complex or a bond similar to the complex with metal ions of the aggregating agent may be optionally used. As the additive, a chelating agent is suitably used.

Examples of the inorganic metal salt include metal salts such as calcium chloride, calcium nitrate, barium chloride, magnesium chloride, zinc chloride, aluminum chloride, and aluminum sulfate; inorganic metal salt polymers such as polyaluminum chloride, polyaluminum hydroxide, and calcium polysulfide; and the like.

As the chelating agent, a water-soluble chelating agent may be used. Examples of the chelating agent include oxycarboxylic acids such as tartaric acid, citric acid, and gluconic acid, iminodiacetic acid (IDA), nitrilotriacetic acid (NTA), ethylenediaminetetraacetic acid (EDTA), and the like.

The amount of the chelating agent added is, for example, in the range of 0.01 part by weight to 5.0 parts by weight, and may be in the range of 0.1 part by weight or more and less than 3.0 parts by weight, based on 100 parts by weight of the polyester resin particles as a binder resin.

Step of Coalescence

Subsequently, the aggregated particle dispersion in which the aggregated particles are dispersed is heated at, for example, a temperature equal to or higher than the glass transition temperature of the polyester resin particles as a binder resin (for example, a temperature equal to or higher than a temperature 10° C. to 30° C. higher than the glass transition temperature of the polyester resin particles) so as to cause the aggregated particles to coalesce, thereby forming toner particles.

Through the above steps, the toner particles are obtained.

The toner particles may also be prepared through a step of forming second aggregated particles, wherein after the aggregated particle dispersion in which the aggregated particles are dispersed is obtained, the aggregated particle dispersion is further mixed with a resin particle dispersion in which the polyester resin particles as a binder resin are dispersed, and the particles are aggregated such that the polyester resin particles are attached to the surface of the aggregated particles, thereby forming the second aggregated particles; and a step of forming toner particles having a core/shell structure by heating a second aggregated particle dispersion in which the second aggregated particles are dispersed so as to cause the second aggregated particles to coalesce.

After the step of coalescence ends, the toner particles formed in a solution go through known washing step, solid-liquid separation step, and drying step, thereby obtaining dry toner particles.

In the washing step, it is preferable to sufficiently perform displacement washing by using deionized water, in view of charging properties. The solid-liquid separation step is not particularly limited, but in view of productivity, suction filtration, pressurizing filtration, and the like may be preferably used. The drying step is also not particularly limited, but in view of productivity, freeze drying, flash jet drying, fluidizing drying, vibration type fluidization drying, and the like may be used preferably.

The toner (1) according to the present exemplary embodiment is prepared by, for example, adding an external additive to the obtained dry toner particles and mixing them. It is preferable that mixing be performed by, for example, a V-blender, a Henschel mixer, and a Lödige mixer. In addition, coarse particles of the toner may optionally be removed using a vibration classifier, a wind classifier, and the like.

Next, toner particles of the toner (2) according to the exemplary embodiment of the present invention will be described.

The toner particles of the toner (2) include a binder resin, a release agent, and optionally a colorant and other additives.

The binder resin is not particularly limited, and examples thereof include homopolymers formed of monomers of styrenes such as styrene, para-chlorostyrene, α-methylstyrene; esters having a vinyl group, such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate; vinyl nitriles such as acrylonitrile and methacrylonitrile; vinyl ethers such as vinyl methyl ether and vinyl isobutyl ether; vinyl ketones such as vinyl methyl ketone, vinyl ethyl ketone, and vinyl isopropenyl ketone; and olefins such as ethylene, propylene, and butadiene, copolymers obtained by combining two or more kinds of the above ones, and mixtures of these. The examples also include non-vinyl condensed resins such as an epoxy resin, a polyester resin, a polyurethane resin, a polyamide resin, a cellulose resin, and a polyether resin, mixtures of these resins with the above vinyl resins, graft polymers obtained by polymerizing vinyl monomers in the presence of the non-vinyl condensed resin and the like.

A styrene resin, a (meth)acrylic resin, and a styrene-(meth) acrylic copolymer resin are obtained by, for example, known methods by using styrene monomers and (meth)acrylic acid monomers singly or in an appropriate combination. In addition, the "(meth)acryl" is a term that includes all of "acryl" and "methacryl".

A polyester resin is obtained by being synthesized using a method known in the related art, for example, ester exchange, polycondensation, or the like, by using a combination of suitable components selected from dicarboxylic acid components and diol components.

When the styrene resin, the (meth)acrylic resin, and the copolymer resin of these are used as a binder resin, it is preferable to use the resin having a weight average molecular weight Mw in the range of 20,000 to 100,000 and a number average molecular weight Mn in the range of 2,000 to 30,000. On the other hand, when the polyester resin is used as a binder resin, it is preferable to use the resin having a weight average molecular weight Mw in the range of 5,000 to 40,000 and a number average molecular weight Mn in the range of 2,000 to 10,000.

The glass transition temperature of the binder resin is preferably in the range of 40° C. to 80° C. If the glass transition temperature is within the above range, a minimum fixing temperature is easily maintained.

Release Agent

Examples of the release agent include hydrocarbon-based wax such as low molecular weight polypropylene and low molecular weight polyethylene, olefin wax, paraffin wax; silicone resins rosin; rice wax; carnauba wax; and the like. The melting temperature of these release agents is preferably from 50° C. to 100° C., and more preferably from 60° C. to 95° C.

The content of the release agent is preferably from 0.5 part by weight to 15 parts by weight, and more preferably from 1.0 part by weight to 12 parts by weight, based on 100 parts by weight of the binder resin.

If the content of the release agent is 0.5 part by weight or more, occurrence of peeling defectiveness is prevented particularly in oil-less fixing. If the content of the release agent is 15 parts by weight or less, fluidity of the toner does not deteriorate, and the reliability of images and image formation is improved.

Colorant

The colorant may be either a dye or a pigment, but in view of lightfastness and waterfastness, a pigment is preferable.

As the colorant, for example, known pigments such as carbon black, aniline black, aniline blue, calcoil blue, chrome yellow, ultramarine blue, Dupont oil red, quinoline yellow, methylene blue chloride, phthalocyanine blue, malachite green oxalate, lamp black, rose red oxide, quinacridone, benzidine yellow, C.I. Pigment•Red 48:1, C.I. Pigment•Red 57:1, C.I. Pigment•Red 122, C.I. Pigment•Red 185, C.I. Pigment•Red 238, C.I. Pigment•Yellow 12, C.I. Pigment•Yellow 17, C.I. Pigment•Yellow 180, C.I. Pigment•Yellow 97, C.I. Pigment•Yellow 74, C.I. Pigment•Blue 15:1, and C.I. Pigment•Blue 15:3 may be used.

Optionally, a surface-treated colorant or a pigment dispersion may be used as the colorant.

By selecting the type of the colorant, a yellow toner, a magenta toner, a cyan toner, a black toner, and the like are obtained.

The content of the colorant is preferably in the range of 1 part by weight to 30 parts by weight based on 100 parts by weight of the binder resin.

Other Additives

Known agents may be used as a charge-controlling agent, and azo-based metal complex compounds, metal complex compounds of salicylic acid, and resin-type charge-controlling agents containing a polar group may be used.

Characteristics of Toner Particles

The shape factor SF1 of the toner particles of the toner (2) of the present exemplary embodiment is preferably in the range of 140 to 160. If the shape factor SF1 of the toner particles is within the above range, reproducibility of a red image under a high humidity is improved. Though unclear, the reason is assumed to be as follows. If the shape factor SF1 of the toner particles is within the above range, the shape of the toner particles becomes irregular. Since red used at the time of image formation in transfer is a second-order color, the toner layer corresponds to a dual-layer type and thus the toner image is heightened as compared to a single-layer type, but the toner particles are not easily scattered since rolling of the toner particles is inhibited. Consequently, concavities and convexities on the surface of the fixed image are reduced, and gloss of the image of the toner particles is improved, hence the reproducibility of the red image under a high humidity is improved.

The shape factor SF1 is more preferably in the range of 145 to 155.

The above shape factor SF1 is calculated by the following Formula (2).

$$SF1=(ML^2/A)\times(\pi/4)\times 100 \qquad \text{Formula (2)}$$

In the Formula (2), ML represents an absolute maximum length of the toner particles, and A represents a projected area of the toner particles.

SF1 is converted into a numerical value mainly by analyzing microscopic images or images of a scanning electron microscope (SEM) by using an image analyzer and calculated by, for example, the following manner. That is, optical microscopic images of particles dispersed on the slide glass surface are provided to a Luzex image analyzer through a video camera, the maximum length and the projected area of 100 particles are obtained and calculated by the Formula (2), and an average thereof is calculated, thereby obtaining SF1.

The volume average particle size of the toner particles of the toner (2) of the present exemplary embodiment is preferably in the range of 8 to 15 μm, more preferably in the range of 9 μm to 14 μm, and even more preferably in the range of 10 μm to 12 μm. If the volume average particle size of the toner (2) is within the above range, reproducibility of a red image under a high humidity is improved. Though unclear, the reason is assumed to be as follows. If the volume average particle size of the toner (2) is within the above range, even though the toner layer corresponds to a dual-layer type and thus the toner image is heightened as compared to a single-layer type since red used at the time of image formation in transfer is a second-order color, the toner particles are not easily scattered since the particles are not easily dispersed due to the large particle size and rolling of the toner (2) is inhibited. Consequently, concavities and convexities on the surface of the fixed image are reduced, and gloss of the image of the toner particles is improved, hence the reproducibility of the red image under a high humidity is improved.

The volume average particle size is measured with Coulter Multisizer (Beckman Coulter, Inc.) at an aperture diameter of 100 μm. At this time, the toner particles are dispersed in an aqueous electrolytic solution (an isotonic solution) and then further dispersed for 30 seconds or longer by ultrasonic waves, and then the measurement is performed.

The glass transition temperature (Tg) of the toner particles of the present exemplary embodiment is preferably from 35° C. to 50° C. If the glass transition temperature (Tg) of the toner particles is within the above range, reproducibility of a red image under a high humidity is improved. Though unclear, the reason is assumed to be as follows. If the glass transition temperature (Tg) of the toner particles is within the above range, the release agent evenly seeps out, so concavities and convexities on the surface of the fixed image are reduced. Consequently, gloss of the image of the toner particles is improved, whereby the reproducibility of a red image under a high humidity is improved.

The glass transition temperature (Tg) of the toner particles is more preferably in the range of 40° C. to 50° C.

The glass transition temperature (Tg) is a value obtained by a measurement based on JIS 7121-1987, which is performed using a differential scanning calorimetry (manufactured by Mac Science Inc.: DSC 3110, thermal analysis system 001). To correct the temperature of a detection portion of the device, a melting point of a mixture of indium and zinc is used, and to correct calorie, heat of fusion of indium is used. A sample (toner) is put in a pan made of aluminum, and the aluminum pan in which the sample was put and an empty aluminum pan for comparison are set, followed by the measurement at a rate of temperature rise of 10° C./min. A temperature at an intersection point of extensions of a base line and a rising line in an endothermic portion of the DSC curve which is obtained by the measurement is taken as the glass transition temperature.

Next, the method of preparing the toner (2) will be described.

In the method of preparing the toner (2) of the present exemplary embodiment, toner particles are prepared by known dry methods such as a kneading and pulverizing method, and the external additive described above is added externally.

The kneading and pulverizing method is a method of preparing toner particles by kneading and pulverizing a material including a binder resin and a release agent.

More specifically, the kneading and pulverizing method is divided into a step of kneading in which the material including a binder resin and a release agent is kneaded and a step of pulverizing in which the kneaded material is pulverized. Optionally, the method may further include other steps such as a step of cooling in which the kneaded material formed by the step of kneading is cooled.

An example of the respective steps will be described in detail.

Step of Kneading

In the step of kneading, a material (hereinbelow, referred to as a "toner (2) particles-forming material" in some cases) that include a binder resin, a release agent, and optionally other additives is kneaded.

In the step of kneading, an aqueous medium (for example, water such as distilled water or deionized water, alcohols, and the like) is preferably added in an amount of from 0.5 part by weight to 5 parts by weight, based on 100 parts by weight of the toner (2) particles-forming material.

Examples of kneaders used in the step of kneading include a single-screw extruder, a double-screw extruder, and the like. Hereinbelow, as an example of the kneader, a kneader having a feed screw portion and two kneading portions will be described using a drawing, but the present invention is not limited thereto.

Figure 3:
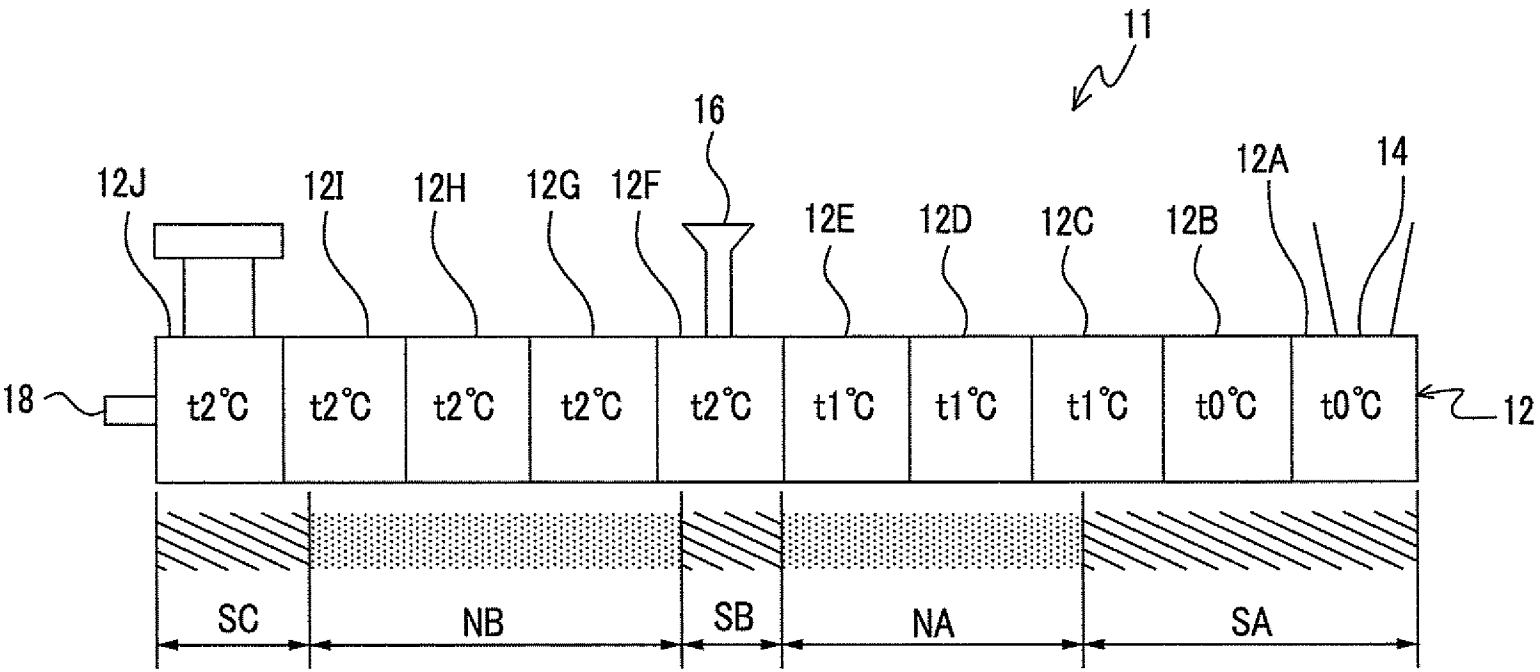
FIG. 3 is a view illustrating the state of a screw in an example of a screw extruder used for preparing an electrostatic charge image developing toner (2) of the exemplary embodiment of the present invention.

FIG. 3 is a view illustrating the state of a screw in an example of the screw extruder used in the step of kneading in the method of preparing the toner (2) of the present exemplary embodiment.

A screw extruder 11 is constituted with a barrel 12 that includes a screw (not shown in the drawing), an inlet 14 for injecting the toner (2) particles-forming material as the material of the toner into the barrel 12, a liquid addition port 16 for adding an aqueous medium to the toner particles-forming material in the barrel 12, and a discharge port 18 that discharges a kneaded material formed when the toner (2) particles-forming material is kneaded in the barrel 12.

The barrel 12 is divided into a feed screw portion SA that transports the toner (2) particles-forming material injected from the inlet 14 to a kneading portion NA, the kneading portion NA for melting and kneading the toner (2) particles-forming material by a first kneading step, a feed screw portion SB that transports the toner (2) particles-forming material melted and kneaded in the kneading portion NA to a kneading portion NB, the kneading portion NB that forms a kneaded material by melting and kneading the toner (2) particles-forming material by a second kneading step, and a feed screw portion SC that transports the formed kneaded material to the discharge port 18, in this order from the portion close to the inlet 14.

Inside the barrel 12, different temperature controllers (not shown in the drawing) are provided to each block. That is, blocks 12A to a block 12J are constituted such that these blocks may be controlled at different temperatures. FIG. 3 shows a state where the temperature of blocks 12A and 12B is controlled to t0° C., the temperature of blocks 12C to 12E is controlled to t1° C., and the temperature of blocks 12F to 12J is controlled to t2° C. Therefore, the toner (2) particles-forming material in the kneading portion NA is heated at 1° C., and the toner particles-forming material in the kneading portion NB is heated at 2° C.

When the toner (2) particles-forming material is supplied to the barrel 12 from the inlet 14, the toner particles-forming material is sent to the kneading portion NA by the feed screw portion SA. At this time, since the temperature of the block 12C is set to t1° C., the toner (2) particles-forming material turns into a melted state by being heated and is sent into the kneading portion NA in this state. Since the temperature of the blocks 12D and 12E is also set to t1° C., the toner (2) particles-forming material is melted and kneaded at t1° C. in the kneading portion NA. The binder resin and release agent turn into a melted state in the kneading portion NA and undergo shearing by the screw.

Subsequently, the toner (2) particles-forming material having undergone kneading in the kneading portion NA is sent to the kneading portion NB by the feed screw portion SB.

Thereafter, an aqueous medium is injected into the barrel 12 from the liquid addition port 16 in the feed screw portion SB, whereby the aqueous medium is added to the toner (2) particles-forming material. Although FIG. 3 shows a state where the aqueous medium is injected in the feed screw portion SB, the present invention is not limited thereto, and the aqueous medium may be injected in the kneading portion NB or in both the feed screw portion SB and the kneading portion NB. That is, the aqueous medium injection position and the aqueous medium-injected site may be optionally selected.

As described above, since the aqueous medium is injected into the barrel 12 from the liquid addition port 16, the toner (2) particles-forming material in the barrel 12 is mixed with the aqueous medium, and the toner particles-forming material is cooled by evaporation latent heat of the aqueous medium, whereby the temperature of the toner (2) particles-forming material is maintained.

Finally, the kneaded material formed by being melted and kneaded by the kneading portion NB is transported to the discharge port 18 by the feed screw portion SC and discharged from the discharge port 18.

The step of kneading using the screw extruder 11 shown in FIG. 3 is performed in the above manner.

Step of Cooling

The step of cooling is a step of cooling the kneaded material formed in the step of kneading described above. In the step of cooling, it is preferable to cool the kneaded material to 40° C. or lower, by decreasing the temperature at an average temperature decrease rate of 4° C./sec or higher from the temperature of the kneaded material at the end of the step of kneading. If the cooling rate of the kneaded material is slow, a mixture (a mixture of the toner (2) particles-forming material) finely dispersed in the binder resin in the step of kneading is recrystallized, so a dispersion diameter increases in some cases. On the other hand, if the kneaded material is rapidly cooled at the above average temperature decrease rate, the dispersed state of the material immediately after the end of the step of kneading is maintained as it is, which thus is preferable. The average temperature decrease rate refers to the average of the rate at which the temperature is decreased to 40° C. from the temperature (for example, t2° C. when the screw extruder 11 shown in FIG. 3 is used) of the kneaded material at the end of the kneading.

Specific examples of the cooling method in the step of cooling include a method of using a rolling roll in which cold water or brine has been circulated, an insertion type cooling belt, and the like. When the cooling is performed by the above method, the cooling rate is determined by the speed of the rolling roll, the amount of the brine flowing, the amount of the kneaded material supplied, the slab thickness of the kneaded material during rolling, and the like. The slab thickness is preferably 1 mm to 3 mm.

Step of Pulverizing

The kneaded material having been cooled by the step of cooling is pulverized by the step of pulverizing, whereby particles are formed. In the step of pulverizing, a mechanical pulverizer, a jet pulverizer, or the like is used, for example.

Step of Classifying

In order to obtain particles of the toner (2) having a volume average particle size in a target range, the particles obtained by the step of pulverizing may be optionally classified by the step of classifying. In the step of classifying, a centrifugal classifier, an inertial classifier or the like which has been used in the related art is used to remove fine powder (particles smaller than a particle size in a target range) and coarse powder (particles bigger than a particle size in a target range).

Step of External Addition

The above-described silica particles are added and attached to the obtained toner (2) particles as an external additive. The silica particles are attached in divided stages by using, for example, a V-shaped blender, a Henschel mixer, a Lödige mixer, and the like.

Step of Sieving

The step of sieving may optionally be performed after the step of external addition. Specific examples of the sieving method include methods of using a Gyro-sifter, a vibration classifier, a wind classifier, and the like. The coarse powder or the like of the external additive is removed by the sieving, and the occurrence of streaks on the photoreceptor, contamination caused by dripping in the device, and the like are inhibited.

Electrostatic Charge Image Developer

The electrostatic charge image developer according to the present exemplary embodiment includes at least the toner according to the present exemplary embodiment.

The electrostatic charge image developer according to the present exemplary embodiment may be a single-component developer including only the toner according to the present exemplary embodiment or may be a two-component developer obtained by mixing the toner with a carrier.

The carrier is not particularly limited, and examples thereof include known carriers such as a resin-coated carrier, a magnetic particles dispersed-type carrier, and the like.

In the two-component developer, the mixing ratio (weight ratio) between the toner according to the present exemplary embodiment and the carrier is preferably in the range of 1:100 to 30:100 (toner:carrier), and more preferably in the range of 3:100 to 20:100.

Image Forming Apparatus and Image Forming Method

Next, the image forming apparatus and the image forming method according to the present exemplary embodiment will be described.

The image forming apparatus according to the present exemplary embodiment includes an image holding member, a charging unit that charges the image holding member, an electrostatic charge image forming unit that forms an electrostatic charge image on the surface of the charged image holding member, a developing unit that contains the electrostatic charge image developer and develops the electrostatic charge image formed on the image holding member as a toner image by using the electrostatic charge image developer, a transfer unit that transfers the toner image formed on the image holding member onto a recording medium, a cleaning unit that cleans the surface of the image holding member, and a fixing unit that fixes the toner image transferred onto the recording medium. This image forming apparatus uses the electrostatic charge image developer according to the present exemplary embodiment as an electrostatic charge image developer.

In the image forming apparatus according to the present exemplary embodiment, for example, the portion including the developing unit may have a cartridge structure (process cartridge) that is detachable from and attachable to the image forming apparatus. As the process cartridge, for example, a process cartridge that contains the electrostatic charge image developer according to the present exemplary embodiment and includes a developing unit is suitably used.

The image forming method according to the present exemplary embodiment includes a step of charging that charges an image holding member, a step of forming an electrostatic charge image that forms an electrostatic charge image on the surface of the charged image holding member, a step of developing that develops the electrostatic charge image formed on the image holding member as a toner image by using an electrostatic charge image developer, a step of transferring that transfers the toner image formed on the image holding member onto a recording medium, a step of cleaning that cleans the surface of the image holding member, and a step of fixing that fixes the toner image transferred onto the recording medium. In this method, the electrostatic charge image developer according to the present exemplary embodiment is used as an electrostatic charge image developer.

An example of the image forming apparatus according to the present exemplary embodiment is shown below, but the present invention is not limited thereto. The main portions shown in the drawing will be described, and other portions will not be described.

FIG. 1 is a schematic configuration view illustrating a 4-drum tandem system color image forming apparatus. The image forming apparatus shown in FIG. 1 includes a first to fourth image forming units 10Y, 10M, 10C, and 10K (image forming units) which employ an electrophotography method in which images of each color including yellow (Y), magenta (M), cyan (C), and black (K) based on image data separated for each color are output. These image forming units (hereinafter, simply referred to as "units" in some cases) 10Y, 10M, 10C, and 10K are arranged in parallel while separating from each other at preset intervals in a horizontal direction. The units 10Y, 10M, 10C, and 10K may be process cartridges detachable from the image forming apparatus.

Above the units 10Y, 10M, 10C, and 10K in the drawing, an intermediate transfer belt 20 extends as an intermediate transfer member while passing the units. The intermediate transfer belt 20 is wound around a driving roller 22 and a supporting roller 24 contacting the inner surface of the intermediate transfer belt 20, which rollers are positioned separately from each other from the left to right in the drawing, and drives in a direction heading to the fourth unit 10K from the first unit 10Y. A force is applied to the supporting roller 24 by a spring not shown in the drawing or the like in a direction separating from the driving roller 22, and a tension is applied to the intermediate transfer belt 20 wound around the both rollers. To the image holding member side of the intermediate transfer belt 20, an intermediate transfer member cleaning device 30 is provided facing the driving roller 22.

The toners of 4 colors including yellow, magenta, cyan, and black contained in toner cartridges 8Y, 8M, 8C, and 8K are supplied to developing devices (developing units) 4Y, 4M, 4C, and 4K, respectively, of the respective units 10Y, 10M, 10C, and 10K.

The first to fourth units 10Y, 10M, 10C, and 10K described above have the same constitution. Therefore, herein, the first unit 10Y which is disposed at the upstream side in the driving direction of the intermediate transfer belt and forms yellow images will be representatively described. In addition, the same portion as that of the first unit 10*y* is marked with reference signs indicating magenta (M), cyan (C), and black (K) instead of yellow (Y) so as not to describe the second to fourth units 10M, 10C, and 10K.

The first unit 10Y includes a photoreceptor 1Y working as an image holding member. Around the photoreceptor 1Y, a charging roller 2Y that charges the surface of the photoreceptor 1Y with a preset potential, an exposure device (electrostatic charge image forming unit) 3 that forms an electrostatic charge image by exposing the charged surface with a laser beam 3Y based on image signals separated for each color, a developing device (developing unit) 4Y that develops the electrostatic charge image by supplying a charged toner to the electrostatic charge image, a primary transfer roller 5Y (primary transfer unit) that transfers the developed toner image to the intermediate transfer belt 20, and a photoreceptor cleaning device (cleaning unit) 6Y that removes the residual toner on the surface of the photoreceptor 1Y after the primary transfer are arranged in order.

The primary transfer roller 5Y is disposed inside the intermediate transfer belt 20, at a position facing the photoreceptor 1Y. Each of the primary transfer rollers 5Y, 5M, 5C, and 5K is respectively connected to a bias power source (not shown in the drawing) applying primary transfer bias. Each bias power source is controlled by a control portion not shown in the drawing, thereby varying transfer bias applied to each of the primary transfer rollers.

Hereinbelow, an operation of forming a yellow image in the first unit 10Y will be described. First, prior to this operation, the surface of the photoreceptor 1Y is charged by the charging roller 2Y with a potential of about −600 V to −800 V.

The photoreceptor 1Y is formed with laminated photosensitive layers on a conductive (volume resistivity at 20° C.: $1\times10^{-6}$ Ωcm or less) substrate. The photosensitive layers show high resistivity (resistivity approximately similar to that of the general resin) in general. However, the layers have a characteristic that when the layers are irradiated with the laser beam 3Y, the specific resistivity of the portion irradiated with the laser beam changes. Therefore, according to image data for yellow transmitted from the control portion not shown in the drawing, the laser beam 3Y is output to the surface of the charged photoreceptor 1Y via the exposure device 3. The laser beam 3Y is emitted to the photosensitive layer on the surface of the photoreceptor 1Y, and as a result, an electrostatic charge image of a yellow printing pattern is formed on the surface of the photoreceptor 1Y.

The electrostatic charge image is an image formed on the surface of the photoreceptor 1Y by charging, and is a so-called negative latent image which is formed in a manner in which the specific resistivity of the portion of the photosensitive layer irradiated with the laser beam 3Y is lowered, and electric charge charging the surface of the photoreceptor 1Y flows while the electric charge in the portion not irradiated with the laser beam 3Y remains.

The electrostatic charge image formed on the photoreceptor 1Y in this manner is rotated to a preset developing position according to driving of the photoreceptor 1Y. In the developing position, the electrostatic charge image on the photoreceptor 1Y is made into a visible image (developed image) by the developing device 4Y.

The electrostatic charge image developer according to the present exemplary embodiment that includes at least, for example, a yellow toner and a carrier is contained in the developing device 4Y. The yellow toner is stirred inside the developing device 4Y so as to be charged triboelectrically, and is held on a developer roller (developer holding member) while having electric charge of the same polarity (negative polarity) as the electric charge charging the photoreceptor 1Y. When the surface of the photoreceptor 1Y passes through the developing device 4Y, the yellow toner is electrostatically attached to the erased latent image portion on the surface of the photoreceptor 1Y, whereby the latent image is developed by the yellow toner. The photoreceptor 1Y where the yellow toner image has been formed drives subsequently at a preset speed, and the toner image developed on the photoreceptor 1Y is transported to a preset primary transfer position.

When the yellow toner image on the photoreceptor 1Y is transported to the primary transfer position, a primary transfer bias is applied to the primary transfer roller 5Y, and an electrostatic force heading to the primary transfer roller 5Y from the photoreceptor 1Y acts on the toner image, whereby the toner image on the photoreceptor 1Y is transferred to the intermediate transfer belt 20. The polarity of the transfer bias applied at this time is (+)polarity which is a reverse polarity of the (−)polarity of the toner. For example, the bias is controlled to about +10 μA in the first unit 10Y, by a control portion (not shown in the drawing).

Meanwhile, the residual toner on the photoreceptor 1Y is removed by the cleaning device 6Y and is collected.

The primary transfer bias applied to the primary transfer rollers 5M, 5C, and 5K arranged from the second unit 10M is also controlled in the same manner as the first units.

In this manner, the intermediate transfer belt 20 to which the yellow image has been transferred through the first unit 10Y is sequentially transported through the second to fourth units 10M, 10C, and 10K, whereby the toner images of each color are superposed and transferred by multi layer transfer.

The intermediate transfer belt 20 to which the toner images of four colors have been transferred by multi layer transfer through the first to fourth units reaches a secondary transfer portion constituted with the intermediate transfer belt 20, the supporting roller 24 contacting the inner surface of the intermediate transfer belt, and a secondary transfer roller (secondary transfer unit) 26 disposed at the image holding surface side of the intermediate transfer belt 20. Meanwhile, recording paper (recording medium) P is supplied through a supply mechanism at a preset timing to the gap where the secondary transfer roller 26 comes into pressure contact with the intermediate transfer belt 20, and a secondary transfer bias is applied to the supporting roller 24. The polarity of the transfer bias applied at this time is (−)polarity which is the same polarity as the (−)polarity of the toner, and the electrostatic force heading to the recording paper P from the intermediate transfer belt 20 acts on the toner image, whereby the toner image on the intermediate transfer belt 20 is transferred onto the recording paper P. At this time, the secondary transfer bias is determined according to resistance detected by a resistance detection unit (not shown in the drawing) that detects the resistance of the secondary transfer portion, and is voltage-controlled.

Thereafter, the recording paper P is sent into a pressure contact portion (nip portion) of a pair of fixing rolls in a fixing device (roll-like fixing unit) 28, and the toner image is fixed onto the recording paper P, whereby a fixed image is formed.

Examples of the recording medium to which the toner image is transferred include plain paper used for electrophotographic copying machine and printer, an OHP sheet, and the like.

In order to further improve smoothness of the surface of the fixed image, it is preferable that the surface of the recording medium be also smooth. Therefore, for example, coated paper obtained by coating the surface of plain paper with a resin or the like, art paper for printing, and the like are suitably used.

The recording paper P in which the color image has been fixed is transported toward a discharge portion, whereby a series of operations of forming a color image end.

The image forming apparatus exemplified above is constituted such that the toner image is transferred to the recording paper P via the intermediate transfer belt 20. However, the present invention is not limited thereto, and the image forming apparatus may be constituted such that the toner image is directly transferred to the recording paper from the photoreceptor.

Process Cartridge and Toner Cartridge

Figure 2:
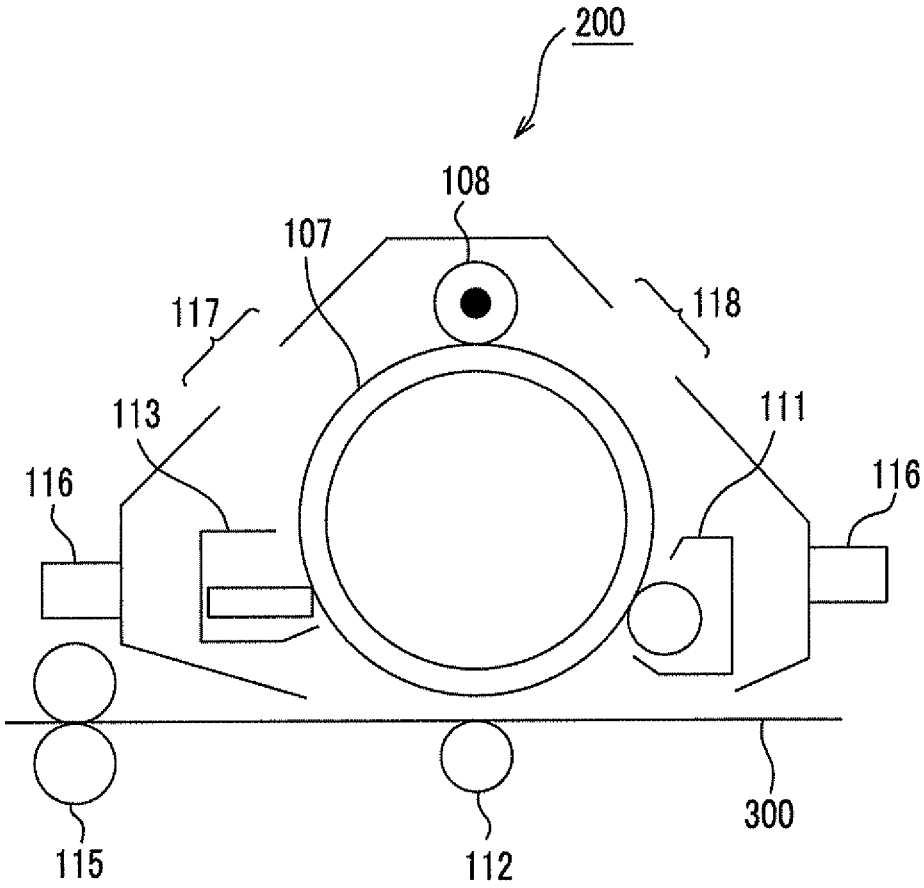
FIG. 2 is a schematic configuration view showing an example of a process cartridge according to the present exemplary embodiment.

FIG. 2 is a schematic configuration view illustrating a suitable example of an exemplary embodiment of a process cartridge containing the electrostatic charge image developer according to the present exemplary embodiment. A process cartridge 200 is formed by combining a photoreceptor 107 with a charging roller 108, a developing device 111, a photoreceptor cleaning device 113, an opening portion 118 for exposure, and an opening portion 117 for erasing exposure by using an assembly rail 116 and integrating these. In addition, in FIG. 2, the sign 300 indicates a recording medium.

The process cartridge 200 is attachable to or detachable from the image forming apparatus constituted with a transfer device 112, a fixing device 115, and other constitutional portions not shown in the drawing.

The process cartridge 200 shown in FIG. 2 includes the charging roller 108, the developing device 111, the cleaning device 113, the opening portion 118 for exposure, and the opening portion 117 for erasing exposure. However, these devices may be selectively combined. The process cartridge of the present exemplary embodiment may include at least one kind selected from a group consisting of the charging roller 108, the developing device 111, the cleaning device (cleaning unit) 113, the opening portion 118 for exposure, and the opening portion 117 for erasing exposure, in addition to the photoreceptor 107.

Next, the toner cartridge according to the present exemplary embodiment will be described. The toner cartridge according to the present exemplary embodiment is a toner cartridge that is detachable from or attachable to the image forming apparatus and contains at least the electrostatic charge image developing toner for replenishing which is to be supplied to the developing unit provided in the image forming apparatus.

The image forming apparatus shown in FIG. 1 is an image forming apparatus having a constitution in which toner cartridges 8Y, 8M, 8C, and 8K are attachable or detachable. The developing devices 4Y, 4M, 4C, and 4K are connected to the respective toner cartridges corresponding to the developing devices (colors) through toner supply tubes not shown in the drawing. When the toner contained in each toner cartridge is decreased, the toner cartridge is replaced.

EXAMPLES

Hereinbelow, the present exemplary embodiment will be described in detail based on examples, but the present exemplary embodiment is not limited to the following examples. In addition, "part(s)" and "%" in the examples refers to "part(s) by weight" and "% by weight" unless otherwise specified.

External Additive

External Additive 1

Preparation Step: Preparation of Alkaline Catalyst Solution (1)

250 parts of methanol and 45 parts of 10% aqueous ammonia are put in a reaction container made of glass that includes a stirring blade, a dropping nozzle, and a thermometer, followed by mixing under stirring, thereby obtaining an alkaline catalyst solution (1). At this time, the amount of the ammonia catalyst of the alkaline catalyst solution (1): amount of $NH_3$ ($NH_3$ [mol]/($NH_3$+methanol+water) [L]) is 0.73 mol/L.

Step of Generating Particles: Preparation of Silica Particle Suspension (1)

First Supply Step

Subsequently, the temperature of the alkaline catalyst solution (1) is adjusted to 30° C., and the alkaline catalyst solution (1) is purged with nitrogen. Thereafter, while the alkaline catalyst solution (1) is being stirred at 120 rpm, tetramethoxysilane (TMOS) and aqueous ammonia having a catalyst ($NH_3$) concentration of 3.7% are added dropwise thereto at flow rates of 4 parts/min and 2.4 parts/min respectively so as to start the supply of the tetramethoxysilane and the aqueous ammonia simultaneously.

At a point in time when 1.5 min has elapsed from the beginning of the supply of the tetramethoxysilane and the aqueous ammonia, the supply of the tetramethoxysilane and the aqueous ammonia is stopped simultaneously. At a point in time when the supply of the tetraalkoxysilane and the aqueous ammonia is stopped, the amount of the supplied tetramethoxysilane is 0.0063 mol/mol based on the amount of the alcohol added to the reaction container in the preparation step.

Maturation Step

The supply of the tetramethoxysilane and the aqueous ammonia is stopped for 1 min.

Second Supply Step 1 min after stopping of the supply of the tetramethoxysilane and the aqueous ammonia, the supply of the tetramethoxysilane and the aqueous ammonia is resumed. For the supply, the flow rates of the tetramethoxysilane and the aqueous ammonia are adjusted to 4 parts/min and 2.4 parts/min respectively, and the tetramethoxysilane and the aqueous ammonia are supplied dropwise.

The total amount of the tetramethoxysilane and the 3.7% aqueous ammonia added in the entire steps including the first and second supply steps is set to 90 parts for the tetramethoxysilane and 54 parts for the 3.7% aqueous ammonia.

After 90 parts of the tetramethoxysilane and 54 parts of the 3.7% aqueous ammonia are added dropwise, a silica particle suspension (1) is obtained.

Removing Solvent and Drying

Subsequently, 150 parts of the solvent of the obtained silica particle suspension (1) is distilled away by heating distillation, and 150 parts of pure water is added thereto, followed by drying by using freeze drier, thereby obtaining irregular hydrophilic silica particles (1).

Hydrophobizing Treatment for Silica Particles 7 parts of hexamethyldisilazane is added to 35 g of the hydrophilic silica particles (1), followed by a reaction at 150° C. for 2 hours, thereby obtaining irregular hydrophobic silica particles [sol-gel silica particles (1)] in which the silica particle surface has undergone hydrophobizing treatment.

The obtained sol-gel silica particles (1) is taken as an external additive 1.

External Additives 2 to 18

Sol-gel silica particles (2) to (18) are prepared in the same manner as the external additive 1, except that the supply time, supply-stopped time, and the TMOS amount at the supply-stopped time are changed according to Table 1, and the particles are taken as external additives 2 to 18.

External Additives 19 to 22

The fumed silicas 1 and 2 described in Table 1 are taken as external additives 19 and 20, and the titanium oxides 1 and 2 described in Table 1 are taken as external additives 21 and 22. The fumed silica 1 is obtained from A90 (manufactured by NIPPON AEROSIL CO., Ltd.), the fumed silica 2 is from A150 (manufactured by NIPPON AEROSIL CO., Ltd.), the titanium oxide 1 is from MT-150W (manufactured by Teika Co., Ltd.), and the titanium oxide 2 is from MT-700B (manufactured by Teika Co., Ltd.), by subjecting them to the hydrophobizing treatment in the same manner as the external additive 1.

Toner Particles

Toner Particles 1: Aggregation and Coalescence Toner Particles

Preparation of Polyester Resin Dispersion

- Ethylene glycol [manufactured by Wako Pure Chemical Industries, Ltd] 37 parts
- Neopentyl glycol [manufactured by Wako Pure Chemical Industries, Ltd] 65 parts
- 1.9-Nonanediol [manufactured by Wako Pure Chemical Industries, Ltd] 32 parts
- Terephthalic acid [manufactured by Wako Pure Chemical Industries, Ltd] 96 parts The above monomers are put in a flask, and the temperature is raised up to 200° C. over 1 hour. After a state where the inside of the reaction system has been stirred is confirmed, 1.2 parts of dibutyltin oxide is put in the flask. In addition, the temperature is raised up to 240° C. from the same temperature over 6 hours while the generated water is being distilled away, a dehydration condensation reaction is continued for another 4 hours at 240° C., thereby obtaining a polyester resin A having an acid value of 9.4 mg KOH/g, a weight average molecular weight of 13,000, and a glass transition temperature of 62° C.

Subsequently, while being in the melted state, the polyester resin A is transferred to Cavitron CD1010 (manufactured by Eurotec, Ltd.) at a rate of 100 parts/min. 0.37% concentration diluted aqueous ammonia obtained by diluting reagent aqueous ammonia with deionized water is put into a tank of an aqueous medium prepared separately and transferred to the Cavitron simultaneously with the melted polyester resin at a rate of 0.1 L/min while being heated at 120° C. by a heat exchanger. The Cavitron is driven under conditions of a rotation speed of a rotor of 60 Hz and a pressure of 5 kg/cm$^2$, thereby obtaining a polyester resin dispersion in which resin particles having a volume average particle size of 160 nm, a solid content of 30%, a glass transition temperature of 62° C., and a weight average molecular weight Mw of 13,000 are dispersed.

Preparation of Colorant Dispersion

| | |
|---|---|
| Cyan pigment [C.I. Pigment Blue 15:3 manufactured by DainichiSeika Color & Chemicals Mfg. Co., Ltd.] | 10 parts |
| Anionic surfactant [Neogen SC manufactured by DAI-ICHI KOGYO SEIYAKU CO., LTD.] | 2 parts |
| Deionized water | 80 parts |

The above components are mixed and dispersed for an hour by a high-pressure impact type dispersing machine ultimizer [HJP 30006 manufactured by SUGINO MACHINE LIMITED], thereby obtaining a colorant dispersion having a volume average particle size of 180 nm and a solid content of 20%.

Preparation of Release Agent Dispersion

| | |
|---|---|
| Carnauba wax [RC-160, melting temperature of 84° C., manufactured by TOAKASEI CO., LTD.] | 50 parts |
| Anionic surfactant [Neogen SC manufactured by DAI-ICHI KOGYO SEIYAKU CO., LTD.] | 2 parts |
| Deionized water | 200 parts |

The above components are heated at 120° C. and mixed and dispersed with ULTRA-TURRAX T50 manufactured by IKA, and then dispersed with a pressure emission type homogenizer, thereby obtaining a release agent dispersion having a volume average particle size of 200 nm and a solid content of 20%.

Preparation of Toner Particles

| | |
|---|---|
| Polyester resin dispersion | 200 parts |
| Colorant dispersion | 25 parts |
| Release agent particle dispersion | 30 parts |
| Polyaluminum chloride | 0.4 part |
| Deionized water | 100 parts |

The above components are put into a stainless steel flask and mixed and dispersed using ULTRA-TURRAX manufactured by IKA, and then heated up to 48° C. by an oil bath for heating while the flask is being stirred. After the mixture is held at 48° C. for 30 minutes, 70 parts of the same polyester resin dispersion as described above is added thereto.

Thereafter, pH in the system is adjusted to 8.0 by using an aqueous sodium hydroxide solution having a concentration of 0.5 mol/L, and the stainless steel flask is sealed. While stirring is being continued by a stirring shaft having a magnetic seal, the flask is heated up to 90° C. and held as is for 3 hours. After the reaction ends, the resultant is cooled at a temperature decrease rate of 2° C./min, followed by filtration and washing with deionized water, and then solid-liquid separation is performed by Nutsche type suction filtration. The resultant is dispersed again using 3 L of deionized water at 30° C., followed by stirring and washing at 300 rpm for 15 minutes. This washing operation is further repeated 6 times, and when pH of the filtrate becomes 7.54, and the electric conductivity thereof becomes 6.5 μS/cm, solid-liquid separation is performed using No. 5A filter paper by Nutsche type suction filtration. Subsequently, vacuum drying is continued for 12 hours, thereby obtaining toner particles 1.

The volume average particle size D50v of the toner particles 1 measured by a Coulter counter is 5.8 μm, and SF1 thereof is 130.

Toner Particles 2: Kneading and Pulverizing Method

Preparation of Toner Particles 2

| | |
|---|---|
| Polyester resin | 85 parts by weight |
| Cyan pigment (copper phthalocyanine C.I. Pigment Blue 15:3 manufactured by DainichiSeika Color & Chemicals Mfg. Co., Ltd. | 7 parts by weight |
| Carnauba wax [RC-160, melting temperature of 84° C., manufactured by TOAKASEI CO., LTD.] | 8 parts by weight |

The above components are premixed using a Henschel mixer and then kneaded using a double-screw kneader. The obtained kneaded material is roll-cooled by a water-cooling type cooling conveyer and roughly pulverized by a pin crusher, and then roughly pulverized further by a hammer mill to obtain a particle size of about 300 μm. The roughly pulverized material is pulverized by a fluidized bed-type pulverizer AFG400 (manufactured by Hosokawa Alpine) and classified by a classifier EJ30, thereby obtaining toner particles 2 having a volume average particle size (D50v) of 6.1 μm. At this time, metatitanic acid is continuously supplied from a supply port of the fluidized bed-type pulverizer AFG400, at a rate of 1 part by weight based on 100 parts by weight of the pulverized particles.

Example 1

Preparation of Toner 1.5 parts of the external additive 1 is added based on 100 parts of the toner particles 1 by using a Henschel mixer, thereby preparing a toner.

Image analysis is performed on the obtained toner, and the external additive 1 (sol-gel silica particles 1) externally added to the toner particles 1 is measured in terms of the average diameter, the average circularity, and the Da/H ratio by the method described above.

Preparation of Electrostatic Charge Image Developer

Preparation of Carrier

| | |
|---|---|
| Ferrite particles (average particle size: 50 μm) | 100 parts |
| Toluene | 14 parts |
| Styrene-methacrylate copolymer (compositional ratio: 90/10) | 2 parts by weight |
| Carbon black (R330 manufactured by Cabot Corporation) | 0.2 part by weight |

First, the above components excluding ferrite particles are stirred for 10 minutes by a stirrer to prepare a coating liquid in which the components are dispersed, and then this coating liquid and ferrite particles are put in a vacuum deaeration type kneader, followed by stirring at 60° C. for 30 minutes. Thereafter, while being heated, the resultant is subjected to deaeration under reduced pressure, followed by drying, thereby preparing a carrier.

4 parts of the toner 1 and 96 parts of the carrier are stirred at 40 rpm for 20 minutes by using a V-blender and sieved with a sieve having an aperture size of 250 μm, thereby preparing an electrostatic charge image developer.

Evaluation

The obtained external additives and the electrostatic charge image developers are evaluated as follows, thereby confirming development durability and cleaning properties of the toner.

The results are shown in Tables 2 and 3.

Evaluation of External Additive

For the obtained toner, the volume average particle size, the average circularity, and the Da/H ratio of the external additive (silica particles) are measured by the method described above. As a result, the volume average particle size is 221 nm, the average circularity is 0.75, and the Da/H ratio is 1.72.

Evaluation of Image Quality

In order to verify the cleaning properties, images are printed out on recording paper (manufactured by Fuji Xerox Office Supplies: J paper) from a DocuCenterColor a450-modified machine by using the electrostatic charge image developer including the toner that contains the external additive 1, thereby performing image quality evaluation. Specifically, 100 sheets of images having an image density of 20% are formed under conditions of 30° C. and 90% RH, and then 50000 sheets of images having an image density of 1% are formed. Thereafter, 100 sheets of images having an image density of 20% are formed again.

For the evaluation, the images having an image density of 20% that are formed before (hereinbelow, referred to as initial stage in some cases) and after (hereinbelow, referred to as after 50000 sheets in some cases) the 50000-sheet formation are visually observed.

The evaluation criteria are shown below.

A: No problem

B: Low density in a portion of images, but unproblematic for use

C: Low density and slight stripes in a portion of images

D: problematic for use (*1: fogging, *2: low density, *3: stripes, 4: white stripes)

Evaluation of Charging Properties

Images are printed out under the same conditions as described above by using the electrostatic charge image developer prepared above, and the charge amount of the electrostatic charge image developer before (initial stage) and after (after 50000 sheets) the 50000-sheet formation is measured using TB-200 (manufactured by Toshiba Chemical Corporation).

Transfer Efficiency FE08-03170

The electrostatic charge image developer prepared above and the toner prepared above as the replenishing toner are filled in a process speed-variable Docucolor 500 (manufactured by Fuji Xerox Co., Ltd)-modified machine, and 50000 sheets of images are continuously formed under conditions of a process speed of 140 mm/sec; a fixing temperature of 140° C.; applied toner amount of 4.5 g/m$^2$; paper: J paper manufactured by Fuji Xerox Co., Ltd (basis weight 82 g/m$^2$) A4 size (width 210 mm×length 297 mm); and an image portion: width 205 mm×length 290 mm (solid image).

In addition, the weight of the toner hopper filled with the replenishing toner is measured as a weight M1 before use and a weight M2 after the 50000-sheet image formation, and the amount of toner consumed (mg/sheet) per sheet of A4 paper is calculated by the following formula.

$$\text{Amount of toner consumed (mg/sheet)} = (M1 - M2) / \text{number of copied } A4 \text{ paper (50000 sheets)}$$

From an amount M3 of the toner collected by the cleaning device of the copying machine and the above value of (m1−m2), a transfer efficiency (%) of the toner is calculated by the following formula.

$$\text{Transfer efficiency (\%)} = ((M1 - M2) - M3)/(M1 - M2) \times 100$$

A transfer efficiency of up to 85% is determined to be an acceptable range.

Storage Properties of Toner

Aggregation properties of the toner before and after storage are evaluated using the toner containing the external additive 1, thereby evaluating storage properties of the toner. Specifically, the toner is stored in an opened packing container at 50° C. for 24 hours, and then 20 g of this toner having been left to stand is applied onto a net having a 45 μm wide mesh. The net is vibrated for 90 seconds, and the percentage of the weight of toner remaining on the net to the total weight of toner (aggregation rate P) is measured. From the result, the storage properties of the toner are evaluated.

The evaluation criteria are shown below.

A: Aggregation rate of less than 10%

B: Aggregation rate of 10% or more and less than 20%

C: Aggregation rate of 20% or more and less than 30%

D: Aggregation rate of 30% or more and less than 50%

E: Aggregation rate of 50% or more

An aggregation rate of less than 30% is determined to be an acceptable range.

Examples 2 to 9 and Comparative Examples 1 to 13

Toners and electrostatic charge image developers are prepared in the same manner as in Example 1, except that the external additive is changed according to Tables 2 and 3, and evaluation is performed in the same manner as in Example 1.

Examples 10 to 12

Toners and electrostatic charge image developers are prepared in the same manner as in Example 1, except that the toner particles 1 in Examples 1 to 3 is changed to toner particles 2 according to Tables 2 and 3, and evaluation is performed in the same manner as in Example 1.

Comparative Examples 14 to 26 and Examples 13 to 15

Toners and electrostatic charge image developers are prepared in the same manner as in Example 1, except that the amount of the external additive added in Comparative Examples 1 to 13 and Examples 10 to 12 is changed to 2 parts from 1.5 parts according to Tables 2 and 3, and evaluation is performed in the same manner as in Example 1.

TABLE 1

| | | | Characteristics | | | First supply step | | Maturation step | Total amount of TMOS added in |
|---|---|---|---|---|---|---|---|---|---|
| | | | Volume average particle size (nm) | Average circularity | Da/H ratio | Supply time [min] | Amount of TMOS based on methanol at the supply-stopped time | Supply-stopped time [min] | first and second supply steps Part(s) by weight [part(s)] |
| Example 1 | External additive 1 | Sol-gel silica 1 | 221 | 0.75 | 1.72 | 1.5 | 0.0063 | 1.0 | 90 |
| Example 2 | External additive 2 | Sol-gel silica 2 | 128 | 0.68 | 1.67 | 0.6 | 0.0030 | 1.0 | 90 |
| Example 3 | External additive 3 | Sol-gel silica 3 | 455 | 0.72 | 1.63 | 2.0 | 0.0078 | 1.0 | 150 |
| Example 4 | External additive 4 | Sol-gel silica 4 | 232 | 0.60 | 1.77 | 1.5 | 0.0065 | 1.5 | 90 |
| Example 5 | External additive 5 | Sol-gel silica 5 | 240 | 0.81 | 1.78 | 1.5 | 0.0065 | 0.8 | 90 |
| Example 6 | External additive 6 | Sol-gel silica 6 | 311 | 0.74 | 1.55 | 0.6 | 0.0030 | 1.0 | 120 |
| Example 7 | External additive 7 | Sol-gel silica 7 | 306 | 0.72 | 1.81 | 0.6 | 0.0030 | 5.0 | 120 |
| Example 8 | External additive 8 | Sol-gel silica 8 | 133 | 0.56 | 1.84 | 0.6 | 0.0030 | 9.5 | 90 |
| Example 9 | External additive 9 | Sol-gel silica 9 | 480 | 0.82 | 1.60 | 1.5 | 0.0065 | 0.8 | 360 |
| Comparative Example 1 | External additive 10 | Sol-gel silica 10 | 80 | 0.74 | 1.75 | 1.5 | 0.0065 | 1.0 | 45 |
| Comparative Example 2 | External additive 11 | Sol-gel silica 11 | 652 | 0.75 | 1.73 | 1.5 | 0.0065 | 1.0 | 480 |
| Comparative Example 3 | External additive 12 | Sol-gel silica 12 | 248 | 0.42 | 1.70 | 1.5 | 0.0030 | 1.0 | 90 |
| Comparative Example 4 | External additive 13 | Sol-gel silica 13 | 233 | 0.95 | 1.73 | 0.2 | 0.0030 | 1.0 | 90 |
| Comparative Example 5 | External additive 14 | Sol-gel silica 14 | 244 | 0.80 | 1.42 | 1.5 | 0.0065 | 0.0 | 90 |
| Comparative Example 6 | External additive 15 | Sol-gel silica 15 | 251 | 0.79 | 2.10 | 1.5 | 0.0065 | 13.0 | 90 |
| Comparative Example 7 | External additive 16 | Sol-gel silica 16 | 521 | 0.77 | 1.70 | 1.5 | 0.0065 | 1.0 | 420 |
| Comparative Example 8 | External additive 17 | Sol-gel silica 17 | 210 | 0.88 | 1.74 | 1.5 | 0.0080 | 1.0 | 90 |
| Comparative Example 9 | External additive 18 | Sol-gel silica 18 | 208 | 0.72 | 1.92 | 1.5 | 0.0065 | 11.0 | 90 |
| Comparative Example 10 | External additive 19 | Fumed silica 1 | 180 | 0.82 | 2.88 | — | — | — | — |
| Comparative Example 11 | External additive 20 | Fumed silica 2 | 62 | 0.72 | 3.01 | — | — | — | — |
| Comparative Example 12 | External additive 21 | Titanium oxide 1 | 40 | 0.81 | 1.40 | — | — | — | — |
| Comparative Example 13 | External additive 22 | Titanium oxide 2 | 120 | 0.62 | 2.31 | — | — | — | — |

TABLE 2

| | External additive | Toner particles | Amount of external additive added based on toner particles (100 parts) [part(s)] | Initial stage Charge (μC/g) | Initial stage Transfer efficiency (%) | Initial stage Image quality evaluation | After 50000 sheets Charge (μC/g) | After 50000 sheets Transfer efficiency (%) | After 50000 sheets Image quality evaluation | Evaluation of storage properties of toner |
|---|---|---|---|---|---|---|---|---|---|---|
| Example 1 | External additive 1 | Toner particles 1 | 1.5 | 42.2 | 95.6 | A | 38.9 | 94.5 | A | A |
| Example 2 | External additive 2 | Toner particles 1 | 1.5 | 55.1 | 95.0 | A | 52.6 | 93.7 | A | A |
| Example 3 | External additive 3 | Toner particles 1 | 1.5 | 38.5 | 96.2 | B | 34.3 | 95.0 | B | B |
| Example 4 | External additive 4 | Toner particles 1 | 1.5 | 44.9 | 94.4 | B | 40.3 | 93.1 | B | B |
| Example 5 | External additive 5 | Toner particles 1 | 1.5 | 41.0 | 94.8 | B | 35.2 | 93.5 | B | B |
| Example 6 | External additive 6 | Toner particles 1 | 1.5 | 37.5 | 94.6 | B | 33.9 | 93.8 | C | B |
| Example 7 | External additive 7 | Toner particles 1 | 1.5 | 38.1 | 94.1 | B | 35.0 | 92.3 | C | B |
| Example 8 | External additive 8 | Toner particles 1 | 1.5 | 54.0 | 94.8 | C | 50.5 | 91.5 | C | C |
| Example 9 | External additive 9 | Toner particles 1 | 1.5 | 37.0 | 95.2 | C | 31.8 | 90.8 | C | B |
| Comparative Example 1 | External additive 10 | Toner particles 1 | 1.5 | 58.9 | 91.5 | A | 22.5 | 84.1 | D(*1) | D |
| Comparative Example 2 | External additive 11 | Toner particles 1 | 1.5 | 28.9 | 95.6 | C | 18.5 | 90.5 | D(*1, *3, *4) | B |
| Comparative Example 3 | External additive 12 | Toner particles 1 | 1.5 | 45.3 | 93.2 | C | 40.8 | 92.5 | D(*3) | B |
| Comparative Example 4 | External additive 13 | Toner particles 1 | 1.5 | 36.6 | 94.6 | C | 31.9 | 86.3 | D(*3) | B |
| Comparative Example 5 | External additive 14 | Toner particles 1 | 1.5 | 40.7 | 94.0 | C | 37.1 | 93.2 | C | D |
| Comparative Example 6 | External additive 15 | Toner particles 1 | 1.5 | 48.3 | 93.8 | C | 29.5 | 86.3 | D(*1) | D |
| Comparative Example 7 | External additive 16 | Toner particles 1 | 1.5 | 30.5 | 94.8 | C | 19.0 | 90.0 | D(*1, *3, *4) | B |
| Comparative Example 8 | External additive 17 | Toner particles 1 | 1.5 | 40.5 | 94.2 | C | 35.5 | 90.1 | C | D |
| Comparative Example 9 | External additive 18 | Toner particles 1 | 1.5 | 40.8 | 93.8 | C | 36.0 | 89.0 | C | D |
| Comparative Example 10 | External additive 19 | Toner particles 1 | 1.5 | 50.9 | 94.9 | C | 38.5 | 90.6 | D(*2) | E |
| Comparative Example 11 | External additive 20 | Toner particles 1 | 1.5 | 62.3 | 90.0 | C | 35.0 | 80.1 | D(*1) | E |
| Comparative Example 12 | External additive 21 | Toner particles 1 | 1.5 | 32.9 | 85.1 | C | 28.1 | 75.3 | D(*1) | E |
| Comparative Example 13 | External additive 22 | Toner particles 1 | 1.5 | 26.5 | 82.9 | C | 18.6 | 67.8 | D(*1) | E |
| Example 10 | External additive 1 | Toner particles 2 | 1.5 | 38.5 | 92.1 | C | 32.3 | 88.0 | C | B |
| Example 11 | External additive 2 | Toner particles 2 | 1.5 | 41.8 | 94.2 | C | 38.9 | 92.0 | C | B |
| Example 12 | External additive 3 | Toner particles 2 | 1.5 | 35.1 | 95.0 | C | 30.5 | 90.0 | C | C |

Image quality evaluation

A: No problem

B: Low density in a portion of images, but unproblematic for use

C: Low density and slight stripes in a portion of images

D: Problematic for use (*1: fogging, *2: low density, *3: stripes, *4: white stripes)

TABLE 3

| | External additive | Toner particles | Amount of external additive added based on toner particles (100 parts) [part(s)] | Initial stage Charge (μC/g) | Initial stage Transfer efficiency (%) | Initial stage Image quality evaluation | After 50000 sheets Charge (μC/g) | After 50000 sheets Transfer efficiency (%) | After 50000 sheets Image quality evaluation | Evaluation of storage properties of toner |
|---|---|---|---|---|---|---|---|---|---|---|
| Comparative Example 14 | External additive 10 | Toner particles 1 | 2 | 60.5 | 95.3 | C | 28.3 | 86.0 | D(*1) | C |
| Comparative Example 15 | External additive 11 | Toner particles 1 | 2 | 30.0 | 96.0 | C | 20.2 | 91.5 | D(*1, *3, *4) | B |
| Comparative Example 16 | External additive 12 | Toner particles 1 | 2 | 47.2 | 94.1 | C | 41.5 | 93.0 | D(*3) | B |
| Comparative Example 17 | External additive 13 | Toner particles 1 | 2 | 38.7 | 95.0 | C | 32.0 | 87.0 | D(*3) | B |
| Comparative Example 18 | External additive 14 | Toner particles 1 | 2 | 41.0 | 96.4 | C | 38.2 | 94.6 | C | C |
| Comparative Example 19 | External additive 15 | Toner particles 1 | 2 | 50.9 | 94.3 | C | 30.0 | 87.9 | D(*1) | C |
| Comparative Example 20 | External additive 16 | Toner particles 1 | 2 | 33.6 | 96.0 | C | 22.7 | 90.9 | D(*1, *3, *4) | B |
| Comparative Example 21 | External additive 17 | Toner particles 1 | 2 | 43.4 | 95.1 | C | 37.0 | 91.0 | C | C |
| Comparative Example 22 | External additive 18 | Toner particles 1 | 2 | 44.0 | 94.8 | C | 37.5 | 90.9 | C | C |
| Comparative Example 23 | External additive 19 | Toner particles 1 | 2 | 51.3 | 95.0 | C | 40.9 | 91.0 | D(*2) | E |
| Comparative Example 24 | External additive 20 | Toner particles 1 | 2 | 64.8 | 92.0 | C | 39.0 | 82.6 | D(*1) | E |
| Comparative Example 25 | External additive 21 | Toner particles 1 | 2 | 35.3 | 87.3 | C | 30.0 | 78.0 | D(*1) | E |
| Comparative Example 26 | External additive 22 | Toner particles 1 | 2 | 27.7 | 86.0 | C | 20.3 | 70.8 | D(*1) | E |
| Example 13 | External additive 1 | Toner particles 2 | 2 | 41.9 | 94.3 | C | 35.6 | 90.0 | C | B |
| Example 14 | External additive 2 | Toner particles 2 | 2 | 45.9 | 95.0 | C | 41.1 | 93.2 | C | B |
| Example 15 | External additive 3 | Toner particles 2 | 2 | 37.3 | 96.3 | C | 31.8 | 91.3 | C | C |

Image quality evaluation
A: No problem
B: Low density in a portion of images, but unproblematic for use
C: Low density and slight stripes in a portion of images
D: Problematic for use (*1: fogging, *2: low density, *3: stripes, *4: white stripes)

From the above results, it is understood that the image quality, charge amount, and transfer efficiency of examples are maintained even after 50000 sheets of images are formed (after 50000 sheets), compared to comparative examples.

It is also confirmed that the external additive is more effective even with a smaller addition amount in examples than in comparative examples.

Toner Particles: Kneading and Pulverizing Method

Synthesis of Polyester Resin

| | |
|---|---|
| Terephthalic acid | 30 mol % |
| Fumaric acid | 70 mol % |
| Bisphenol A ethylene oxide 2 mol adduct | 20 mol % |
| Bisphenol A propylene oxide adduct | 80 mol % |

The above monomers are put in a flask having an internal capacity of 5 L that includes a stirring device, a nitrogen-introducing tube, a temperature sensor, and a rectification column, and the temperature is raised up to 190° C. over an hour. After the state where the inside of the reaction system has been stirred is confirmed, 1.2 parts by weight of dibutyltin oxide is added to the mixture based on 100 parts by weight of the monomer components. The temperature is raised up to 240° C. from the same temperature over 6 hours while the generated water is being distilled away, a dehydration condensation reaction is continued for another 3 hours at 240° C., thereby obtaining a polyester resin having a weight average molecular weight of 12700.

Preparation of Toner Particles

| | |
|---|---|
| Polyester resin | 85 parts by weight |
| Cyan pigment (copper phthalocyanine C.I. Pigment Blue 15:3 manufactured by DainichiSeika Color & Chemicals Mfg. Co., Ltd.) | 7 parts by weight |
| Carnauba wax RC-160 (melting temperaure of 84° C., manufactured by TOAKASEI CO., LTD.) | 8 parts by weight |

The above components are premixed using a Henschel mixer and then kneaded using a double-screw kneader. The obtained kneaded material is roll-cooled by a water-cooling type cooling conveyer and roughly pulverized by a pin crusher, and then roughly pulverized further by a hammer mill to obtain a particle size of about 300 μm. The roughly pulverized material is pulverized by a fluidized bed-type pulverizer AFG400 (manufactured by Hosokawa Alpine) and classified by a classifier EJ30, thereby obtaining toner particles having a volume average particle size (D50v) of 6.1 μm.

Example 16

Preparation of Toner 1.5 parts of the external additive 1 is added based on 100 parts of the toner particles by using a Henschel mixer, thereby preparing a toner.

Image analysis is performed on the obtained toner, and the external additive 1 (sol-gel silica particles 1) externally added to the toner particles is measured in terms of the average diameter, the average circularity, and the Da/H ratio by the method described above.

Preparation of Electrostatic Charge Image Developer

Preparation of Carrier

| | |
|---|---|
| Ferrite particles (average particle size: 50 μm) | 100 parts by weight |
| Toluene | 14 parts by weight |
| Styrene-methacrylate copolymer (compositional ratio: 90/10) | 2 parts by weight |
| Carbon black (R330 manufactured by Cabot Corporation) | 0.2 part by weight |

First, the above components excluding ferrite particles are stirred for 10 minutes by a stirrer to prepare a coating liquid in which the components are dispersed, and then this coating liquid and ferrite particles are put in a vacuum deaeration type kneader, followed by stirring at 60° C. for 30 minutes. Thereafter, while being heated, the resultant is subjected to deaeration under reduced pressure, followed by drying, thereby preparing a carrier.

4 parts of the toner and 96 parts of the carrier are stirred at 40 rpm for 20 minutes by using a V-blender and sieved with a sieve having an aperture size of 250 μm, thereby preparing an electrostatic charge image developer.

Evaluation

The obtained external additive and the electrostatic charge image developer are evaluated regarding the following items.

The results are shown in Table 2.

Evaluation of External Additive

For the obtained toner, the average diameter, the average circularity, and the Da/H ratio of the external additive (silica particles) 1 are measured by the method described above. As a result, the average diameter is 221 nm, the average circularity is 0.75, and the Da/H ratio is 1.72.

Evaluation of Fixing Temperature Range

The toner is filled in a machine obtained by modifying a bench fixing machine (FBNF fixing, manufactured by Fuji Xerox Co., Ltd) for a process speed-variable DocuCenterColor a450, and a fixing test is performed under a condition in which the process speed is fixed at 150 mm/sec, by varying the fixing temperature in a range of from 150° C. to 210° C.

The amount of toner applied is adjusted to 4.5 g/m$^2$, and white A4 size paper (manufactured by Fuji Xerox Co., Ltd, C2 paper) is used as paper. A minimal temperature at which the toner components are transferred (hot offset) to a fixing member is determined to be a maximum fixing temperature (hot offset-occurring temperature). When hot offset does not occur at 210° C., the temperature is recorded as 220° C., but this means that fixing is not performed since thermal resistance of the belt is low at 220° C.

In the evaluation, a no fixing-occurring temperature of 130° C. or lower and a hot offset-occurring temperature of 200° C. or higher is determined to be an acceptable range.

Evaluation of Image Quality

In order to evaluate the cleaning properties, images are printed on recording paper (manufactured by Fuji Xerox Office Supplies: J paper) from a DocuCenterColor a450-modified machine by using the electrostatic charge image developer including the toner that contains the external additive 1, thereby performing image quality evaluation.

Specifically, 10 sheets of images having an image density of 20% are formed under conditions of 30° C. and 90% RH, and then 50000 sheets of images having an image density of 1% are formed. Thereafter, 10 sheets of images having an image density of 20% are formed again.

For the evaluation, the images having an image density of 20% that are formed before (hereinbelow, referred to as initial stage in some cases) and after (hereinbelow, referred to as after 50000 sheets in some cases) the 50000-sheet formation are visually observed.

The evaluation criteria are shown below.

A: No problem

B: Low density in a portion of images, but unproblematic for use

C: Low density and slight stripes in a portion of images

D; Problematic for use (*1: fogging, *2: low density, *3: stripes, *4: white stripes)

Examples 17 to 24 and Comparative Examples 27 to 39

Toners and electrostatic charge image developers are prepared in the same manner as in Example 16, except that the external additive is changed according to Table 4, and evaluation is performed in the same manner as in Example 16.

Comparative Examples 40 to 52

Toners and electrostatic charge image developers are prepared in the same manner as in Example 16, except that the amount of the external additive added in Comparative Examples 27 to 39 is changed to 2 parts according to Table 4, and evaluation is performed in the same manner as in Example 16.

The average diameter, average circularity, and Da/H ratio of the used external additives 2 to 22 are measured in the method described above, and the results are shown in Table 4.

TABLE 4

| | External additive | Amount of external additive added based on toner particles (100 parts) [part(s)] | Image quality Initial stage | Image quality After 50000 sheets | Maximum fixing temperature (° C.) |
|---|---|---|---|---|---|
| Example 16 | External additive 1 | 1.5 | A | A | 220 |
| Example 17 | External additive 2 | 1.5 | A | A | 220 |
| Example 18 | External additive 3 | 1.5 | B | B | 210 |
| Example 19 | External additive 4 | 1.5 | B | B | 210 |
| Example 20 | External additive 5 | 1.5 | B | B | 210 |
| Example 21 | External additive 6 | 1.5 | B | C | 200 |

TABLE 4-continued

| | External additive | Amount of external additive added based on toner particles (100 parts) [part(s)] | Image quality Initial stage | After 50000 sheets | Maximum fixing temperature (° C.) |
|---|---|---|---|---|---|
| Example 22 | External additive 7 | 1.5 | B | C | 210 |
| Example 23 | External additive 8 | 1.5 | C | C | 210 |
| Example 24 | External additive 9 | 1.5 | C | C | 200 |
| Comparative Example 27 | External additive 10 | 1.5 | A | D(*1) | 165 |
| Comparative Example 28 | External additive 11 | 1.5 | C | D(*1, *3, *4) | 170 |
| Comparative Example 29 | External additive 12 | 1.5 | C | D(*3) | 190 |
| Comparative Example 30 | External additive 13 | 1.5 | C | D(*3) | 175 |
| Comparative Example 31 | External additive 14 | 1.5 | C | C | 180 |
| Comparative Example 32 | External additive 15 | 1.5 | C | D(*1) | 180 |
| Comparative Example 33 | External additive 16 | 1.5 | C | D(*1, *3, *4) | 170 |
| Comparative Example 34 | External additive 17 | 1.5 | C | D(*3) | 210 |
| Comparative Example 35 | External additive 18 | 1.5 | C | D(*4) | 210 |
| Comparative Example 36 | External additive 19 | 1.5 | C | D(*2) | 175 |
| Comparative Example 37 | External additive 20 | 1.5 | C | D(*1) | 160 |
| Comparative Example 38 | External additive 21 | 1.5 | C | D(*1) | 155 |
| Comparative Example 39 | External additive 22 | 1.5 | C | D(*1) | 160 |
| Comparative Example 40 | External additive 10 | 2.0 | B | D(*1) | 155 |
| Comparative Example 41 | External additive 11 | 2.0 | B | D(*1, *3, *4) | 170 |
| Comparative Example 42 | External additive 12 | 2.0 | A | D(*3) | 185 |
| Comparative Example 43 | External additive 13 | 2.0 | B | D(*3) | 170 |
| Comparative Example 44 | External additive 14 | 2.0 | B | C | 175 |
| Comparative Example 45 | External additive 15 | 2.0 | B | D(*1) | 175 |
| Comparative Example 46 | External additive 16 | 2.0 | B | D(*1, *3, *4) | 170 |
| Comparative Example 47 | External additive 17 | 2.0 | B | D(*3) | 200 |
| Comparative Example 48 | External additive 18 | 2.0 | B | D(*4) | 200 |
| Comparative Example 49 | External additive 19 | 2.0 | B | D(*2) | 170 |
| Comparative Example 50 | External additive 20 | 2.0 | B | D(*1) | 160 |
| Comparative Example 51 | External additive 21 | 2.0 | B | D(*1) | 150 |
| Comparative Example 52 | External additive 22 | 2.0 | B | D(*1) | 155 |

Image quality
A: No problem
B: Low density in a portion of images, but unproblematic for use
C: Low density and slight stripes in a portion of images
D: *1: fogging, *2: low density, *3: stripes, *4: white stripes As shown in the above results, the fixing temperature range is wider in examples than in comparative examples.

In addition, it is understood that the image quality, charge amount, and the transfer efficiency are maintained even after 50000 sheets of images are formed (after 50000 sheets).

It is also confirmed that the external additive is more effective even with a smaller addition amount in examples than in comparative examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner comprising:

toner particles; and an external additive, wherein the toner particles are (1) toner particles prepared by forming aggregated particles by aggregating resin particles in a raw material dispersion in which the resin particles are dispersed, and causing the aggregated particles to coalesce by heating an aggregated particle dispersion in which the aggregated particles are dispersed so as to form the toner particles, or (2) toner particles obtained by kneading and pulverizing a material including a binder resin and a release agent, and the external additive is silica particles having an average diameter in the range of 100 nm to 500 nm, an average circularity in the range of 0.5 to 0.85, and an average of a ratio of a circle-equivalent diameter Da obtained by plane image analysis to a maximum height H obtained by 3-D image analysis of greater than 1.5 and less than 1.9.

2. The electrostatic charge image developing toner according to claim 1, wherein the average diameter of the silica particles is in the range of 100 nm to 350 nm.

3. The electrostatic charge image developing toner according to claim 1, wherein the average circularity of the silica particles is in the range of 0.6 to 0.8.

4. The electrostatic charge image developing toner according to claim 1, wherein in the silica particles, the average of the ratio of the circle-equivalent diameter Da obtained by plane image analysis to the maximum height H obtained by 3-D image analysis is in the range of 1.6 to 1.8.

5. The electrostatic charge image developing toner according to claim 1, wherein a content of the silica particles is in the range of 0.1 part by weight to 3.0 parts by weight based on 100 parts by weight of the toner particles.

6. The electrostatic charge image developing toner according to claim 1, wherein the silica particles are treated with a hydrophobizing agent.

7. The electrostatic charge image developing toner according to claim 1, wherein a shape factor SF1 of the toner particles (1) is in the range of 110 to 150.

8. The electrostatic charge image developing toner according to claim 1, wherein a shape factor SF1 of the toner particles (2) is in the range of 140 to 160.

9. An electrostatic charge image developer comprising:

the electrostatic charge image developing toner according to claim 1.

10. The electrostatic charge image developer according to claim 9, wherein in the electrostatic charge image developing toner, the average circularity of the silica particles is in the range of 0.6 to 0.8.

11. A toner cartridge comprising:

a toner containing chamber that accommodates the electrostatic charge image developing toner according to claim 1.

12. The toner cartridge according to claim 11, wherein in the electrostatic charge image developing toner, the average circularity of the silica particles is in the range of 0.6 to 0.8.

13. A process cartridge for an image forming apparatus, comprising:

an image holding member; and a developing unit that forms a toner image by developing an electrostatic charge image formed on a surface of the image holding member by using a developer, wherein the developer is the electrostatic charge image developer according to claim 9.

14. The process cartridge for an image forming apparatus according to claim 13, wherein in the electrostatic charge image developing toner, the average circularity of the silica particles is in the range of 0.6 to 0.8.

15. An image forming apparatus comprising:

an image holding member;

a charging unit that charges a surface of the image holding member;

an electrostatic charge image forming unit that forms an electrostatic charge image on the surface of the image holding member;

a developing unit that forms a toner image by developing the electrostatic charge image formed on the surface of the image holding member by using the developer according to claim 9;

a transfer unit that transfers the developed toner image to a recording medium;

a cleaning unit that cleans the surface of the image holding member; and a fixing unit that fixes the toner image to the recording medium.

16. The image forming apparatus according to claim 15, wherein in the electrostatic charge image developing toner, the average circularity of the silica particles is in the range of 0.6 to 0.8.

17. An image forming method comprising:

charging a surface of an image holding member;

forming an electrostatic charge image on the surface of the image holding member;

developing the electrostatic charge image formed on the surface of the image holding member by using the developer according to claim 9 so as to form a toner image;

transferring the developed toner image to a recording medium;

cleaning the surface of the image holding member; and fixing the toner image to the recording member.

18. The image forming method according to claim 17, wherein in the electrostatic charge image developing toner, the average circularity of the silica particles is in the range of 0.6 to 0.8.

* * * * *